US009441823B1

(12) United States Patent
Chen

(10) Patent No.: US 9,441,823 B1
(45) Date of Patent: Sep. 13, 2016

(54) MODULAR LIGHTED ARTIFICIAL TREE

(71) Applicant: Willis Electric Co., Ltd, Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 14/171,407

(22) Filed: Feb. 3, 2014

Related U.S. Application Data

(63) Continuation of application No. 13/710,003, filed on Dec. 10, 2012.

(60) Provisional application No. 61/568,926, filed on Dec. 9, 2011.

(51) Int. Cl.

| | |
|---|---|
| ***F21S 6/00*** | (2006.01) |
| ***F21V 21/00*** | (2006.01) |
| ***F21V 23/06*** | (2006.01) |
| ***F21V 33/00*** | (2006.01) |

(52) U.S. Cl.
CPC ..... *F21V 23/06* (2013.01); *F21V 33/00* (2013.01)

(58) Field of Classification Search
CPC .... A47G 33/06; A47G 33/122; A47G 33/12; F21W 2121/04; F21W 2121/00; A41G 1/007; A41G 1/005; F21S 4/001; F21V 23/06; F21V 33/00
USPC ..... 362/122–123, 249.06, 249.14–249.19, 362/806, 249.14–219.19, 249.14–29.19
See application file for complete search history.

(56) References Cited

U.S. PATENT DOCUMENTS

| | | | |
|---|---|---|---|
| 438,310 | A | 10/1890 | Edison |
| 35,010 | A | 7/1903 | Zahl |
| 860,406 | A | 7/1907 | McGahan |
| 1,314,008 | A | 8/1919 | McWilliams |
| 1,495,695 | A | 5/1924 | Karr |
| 1,536,332 | A | 5/1925 | Dam |

(Continued)

FOREIGN PATENT DOCUMENTS

| | | | |
|---|---|---|---|
| CA | 1182513 | A | 2/1985 |
| CN | 2102058 | U | 4/1992 |

(Continued)

OTHER PUBLICATIONS

Application and File History for U.S. Appl. No. 14/178,562, filed Feb. 12, 2014, inventor Chen.

(Continued)

*Primary Examiner* — Jong-Suk (James) Lee
*Assistant Examiner* — Erin Kryukova
(74) *Attorney, Agent, or Firm* — Christensen Fonder P.A.

(57) ABSTRACT

A modular, lighted artificial tree that includes a base portion for supporting the artificial tree and a first tree portion. The first tree portion includes a trunk portion having a first end and a second end, and forms a trunk wall, the trunk wall defines a trunk cavity and a plurality of apertures. The first end of the trunk portion is configured to couple with the base portion. The first tree portion also includes a plurality of branches coupled to the trunk portion; a first tree portion power-supply wiring harness within the trunk cavity and extending from the first end of the trunk portion to the second end of the trunk portion; a first light string operably coupled to the power-supply wiring harness. The first wire and the second wire pass through a common aperture to electrically connect to the wiring harness.

18 Claims, 20 Drawing Sheets

(56) References Cited

U.S. PATENT DOCUMENTS 1,656,148 A 1/1928 Harris
1,677,972 A * 7/1928 Marks ..... 362/123
1,895,656 A 1/1933 Gadke
1,974,472 A 9/1934 Seghers
2,025,189 A 12/1935 Yanchenko
2,050,364 A 8/1936 Morton
2,072,337 A 3/1937 Kamm
2,112,281 A 3/1938 Ferris
2,186,351 A 1/1940 Stojaneck
2,188,529 A * 1/1940 Angelo ..... 362/123
2,466,499 A 4/1949 Sokolik
2,484,596 A 10/1949 Waltz
2,484,813 A 10/1949 Waltz
2,533,374 A 12/1950 Hyland
2,563,713 A 8/1951 Frei et al.
2,570,751 A 10/1951 Benander
2,636,069 A 4/1953 Gilbert
2,782,296 A 2/1957 Walter
2,806,938 A 9/1957 Henry
2,857,506 A 10/1958 Minteer
2,863,037 A 12/1958 Johnstone
2,932,811 A 4/1960 Abraham et al.
2,969,456 A * 1/1961 Raymaley ..... 362/123
2,973,546 A 3/1961 Roche
2,984,813 A 5/1961 Bossi
3,107,966 A 10/1963 Bonhomme
3,115,435 A 12/1963 Abramson
3,118,617 A * 1/1964 Tobias ..... 362/123
3,120,351 A 2/1964 Kirsten
3,131,112 A 4/1964 Abramson
3,214,318 A 10/1965 Snow
3,214,579 A 10/1965 Pacini
3,233,207 A 2/1966 Ahroni et al.
3,286,088 A 11/1966 Ahroni
3,296,430 A 1/1967 Eckert
3,345,482 A 10/1967 Lou
3,398,260 A 8/1968 Martens
3,470,527 A 9/1969 Bonhomme
3,504,169 A 3/1970 Freeburger
3,521,216 A 7/1970 Tolegian
3,522,579 A 8/1970 Matsuya
3,571,586 A 3/1971 Duckworth
3,574,102 A 4/1971 Hermanson
3,585,564 A 6/1971 Skjervoll
3,594,260 A 7/1971 Smith
3,603,780 A 9/1971 Lu
3,616,107 A 10/1971 Kershner
3,617,732 A 11/1971 Fisher
3,640,496 A 2/1972 Duncan
3,663,924 A 5/1972 Gerlat
3,704,366 A 11/1972 Korb et al.
3,715,708 A 2/1973 Lloyd et al.
3,728,787 A 4/1973 McDonough
3,764,862 A 10/1973 Jankowski
3,783,437 A 1/1974 Graff et al.
3,806,399 A 4/1974 Cocjin
3,812,380 A 5/1974 Davis, Jr.
3,819,459 A 6/1974 Wren
3,914,786 A 10/1975 Grossi
3,970,834 A * 7/1976 Smith ..... 362/123
3,971,619 A 7/1976 Rohrssen
3,985,924 A 10/1976 Pritza
4,012,631 A 3/1977 Creager
4,020,201 A 4/1977 Miller
4,045,868 A 9/1977 Ammon et al.
4,072,857 A * 2/1978 DeVicaris ..... 362/123
4,097,917 A 6/1978 McCaslin
4,109,345 A 8/1978 Sargent et al.
4,140,823 A 2/1979 Weskamp
4,161,768 A 7/1979 Gauthier et al.
4,245,875 A 1/1981 Shaffer et al.
4,248,916 A 2/1981 Chase
4,262,480 A 4/1981 Wasserman et al.
4,273,814 A 6/1981 Koehler
4,291,075 A 9/1981 Puleo
4,340,841 A 7/1982 Schupp
4,343,842 A 8/1982 Chase
4,437,782 A 3/1984 Geisthoff
4,447,279 A 5/1984 Boisvert et al.
4,451,510 A 5/1984 Boisvert et al.
4,462,065 A 7/1984 Rhodes
4,493,523 A 1/1985 Leong et al.
4,496,615 A 1/1985 Huang
4,516,193 A 5/1985 Murphy
4,519,666 A 5/1985 Williams et al.
4,546,041 A 10/1985 Keane et al.
4,573,102 A 2/1986 Norwood
4,620,270 A 10/1986 Laasko
4,631,650 A 12/1986 Ahroni
4,659,597 A 4/1987 Lau
4,675,575 A 6/1987 Smith et al.
4,712,299 A 12/1987 Loewen et al.
4,720,272 A 1/1988 Durand
4,727,449 A 2/1988 Fleck
4,753,600 A 6/1988 Williams
4,759,729 A 7/1988 Kemppainen et al.
4,769,579 A 9/1988 Jou
4,772,215 A 9/1988 Falk
4,775,922 A 10/1988 Engel
4,777,573 A 10/1988 Liao
4,779,177 A 10/1988 Ahroni
4,789,570 A 12/1988 Maddock
4,799,902 A 1/1989 Laudig et al.
4,805,075 A 2/1989 Damore
4,807,098 A 2/1989 Ahroni
4,808,885 A 2/1989 Bausch et al.
4,855,880 A 8/1989 Mancusi Jr.
4,859,205 A 8/1989 Fritz
4,867,690 A 9/1989 Thumma
4,870,547 A 9/1989 Crucefix
4,870,753 A 10/1989 Pfeffer et al.
4,894,019 A 1/1990 Howard
4,899,266 A 2/1990 Ahroni
4,908,743 A 3/1990 Miller
4,921,426 A 5/1990 Kawasaki et al.
4,934,964 A 6/1990 Mazelle
5,015,510 A 5/1991 Smith
5,033,976 A 7/1991 Sarian et al.
5,051,877 A 9/1991 Liao
5,071,362 A 12/1991 Martens et al.
5,073,132 A 12/1991 Nottrott
5,088,669 A 2/1992 Zinnbauer
5,091,834 A 2/1992 Kao et al.
5,104,608 A 4/1992 Pickering
5,109,324 A 4/1992 Ahroni
5,121,310 A 6/1992 Ahroni
5,139,343 A 8/1992 Lin
5,149,282 A 9/1992 Donato
5,154,508 A 10/1992 Ahroni
5,213,407 A 5/1993 Eisenbraun
5,217,382 A 6/1993 Sparks
5,218,233 A 6/1993 Takahashi
5,281,158 A 1/1994 Lin
5,334,025 A 8/1994 Föhl
5,342,661 A 8/1994 Wilcox, II
5,349,780 A 9/1994 Dyke
5,350,315 A 9/1994 Cheng et al.
5,366,386 A 11/1994 Liao
5,380,215 A 1/1995 Huang
5,389,008 A 2/1995 Cheng et al.
5,390,463 A 2/1995 Sollner
D356,246 S 3/1995 Adams
5,409,403 A 4/1995 Falossi et al.
5,442,258 A 8/1995 Shibata
5,453,664 A 9/1995 Harris
5,455,750 A 10/1995 Davis et al.
5,456,620 A 10/1995 Kaminski
5,481,444 A 1/1996 Schultz
D367,257 S 2/1996 Buelow et al.
5,517,390 A 5/1996 Zins
5,518,425 A 5/1996 Tsai
5,536,538 A 7/1996 Hartung
5,541,818 A 7/1996 Ng et al.
5,550,720 A 8/1996 Carroll

(56) References Cited

U.S. PATENT DOCUMENTS 5,559,681 A 9/1996 Duarte
5,560,975 A 10/1996 Casper
D375,483 S 11/1996 Tashiro
5,580,159 A 12/1996 Liu
5,586,905 A 12/1996 Marshall et al.
5,605,395 A 2/1997 Peng
5,607,328 A 3/1997 Joly
5,624,283 A 4/1997 Hotea
5,626,419 A 5/1997 Lin
5,639,157 A 6/1997 Yeh
5,652,032 A 7/1997 Kac
5,653,616 A 8/1997 Hotea
5,695,279 A 12/1997 Sonnleitner
5,702,262 A 12/1997 Brown et al.
5,702,268 A 12/1997 Lien et al.
5,707,136 A 1/1998 Byers
5,709,457 A 1/1998 Hara
5,712,002 A 1/1998 Reilly, III
5,720,544 A 2/1998 Shu
5,722,766 A 3/1998 Shu
5,727,872 A 3/1998 Liou
5,759,062 A 6/1998 Chen
5,775,933 A 7/1998 Chen
5,776,559 A 7/1998 Woolford
5,776,599 A 7/1998 Haluska et al.
5,785,412 A 7/1998 Wu et al.
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,822,855 A 10/1998 Szczesny et al.
5,828,183 A 10/1998 Wang
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,451 A 12/1998 Chou
5,855,705 A * 1/1999 Gauthier ..... 156/61
5,860,731 A 1/1999 Martinez
5,860,830 A 1/1999 Wu
5,869,151 A 2/1999 Chong
5,878,989 A 3/1999 Allman
5,893,634 A 4/1999 Wang
5,908,238 A 6/1999 Huang
5,915,827 A 6/1999 Wang
5,921,806 A 7/1999 Shuey
5,934,793 A 8/1999 Rahman
5,937,496 A 8/1999 Benoit et al.
5,938,168 A 8/1999 Adams
5,944,408 A 8/1999 Tong et al.
5,957,723 A 9/1999 Gort-Barten
5,962,088 A 10/1999 Tanaka et al.
5,966,393 A 10/1999 Hide et al.
5,971,810 A 10/1999 Taylor
5,979,859 A 11/1999 Vartanov et al.
6,004,006 A 12/1999 Wang
6,007,362 A 12/1999 Davis et al.
6,030,670 A 2/2000 Chang
6,053,774 A 4/2000 Lin
6,056,427 A 5/2000 Kao
6,079,848 A 6/2000 Ahroni
6,084,357 A 7/2000 Janning
6,086,395 A 7/2000 Lloyd et al.
6,095,874 A 8/2000 Quaranta
6,099,920 A 8/2000 Kao
6,111,201 A 8/2000 Drane et al.
6,113,430 A 9/2000 Wu
6,116,563 A 9/2000 Tsai
6,120,312 A 9/2000 Shu
6,123,433 A 9/2000 Chen
6,126,298 A 10/2000 Wu
6,139,376 A 10/2000 Ooya et al.
6,147,367 A 11/2000 Yang et al.
6,149,448 A 11/2000 Haller et al.
6,155,697 A 12/2000 Ahroni
6,162,515 A 12/2000 Hill
6,203,169 B1 3/2001 Coushaine et al.
6,217,191 B1 4/2001 Wu et al.
6,228,442 B1 * 5/2001 Coco ..... 428/18
6,241,559 B1 6/2001 Taylor
6,245,425 B1 6/2001 McCullough et al.
6,257,736 B1 7/2001 Fehrenbach
6,257,740 B1 7/2001 Gibboney, Jr.
6,257,793 B1 7/2001 Lin
6,261,119 B1 7/2001 Green
6,273,574 B1 8/2001 Wang et al.
6,283,797 B1 9/2001 Wu
6,302,562 B1 10/2001 Wu
6,320,327 B1 11/2001 Lavatelli et al.
6,328,593 B1 12/2001 Chang et al.
6,347,965 B1 2/2002 Pan
D454,110 S 3/2002 Andre et al.
6,354,719 B1 3/2002 Pan
6,361,368 B1 3/2002 Tseng
6,363,607 B1 4/2002 Chen et al.
6,407,411 B1 6/2002 Wojnarowski et al.
6,452,317 B1 9/2002 Tseng
6,457,839 B1 10/2002 Grndoit
6,458,435 B1 10/2002 Lai
6,514,581 B1 2/2003 Gregory
6,533,437 B1 3/2003 Ahroni
6,536,916 B1 3/2003 Rahman
6,541,800 B2 4/2003 Barnett et al.
6,544,070 B1 4/2003 Radliff
6,571,340 B1 5/2003 Lee
6,575,595 B1 6/2003 Wu
6,576,844 B1 6/2003 Kamata
6,580,182 B2 6/2003 Janning
6,588,914 B1 7/2003 Tang
6,592,094 B1 7/2003 Kao
6,595,657 B1 7/2003 Shieh
D478,310 S 8/2003 Andre et al.
6,609,814 B2 8/2003 Ahroni
6,623,291 B1 9/2003 Tsai
6,634,766 B1 10/2003 Gordon
6,644,836 B1 11/2003 Adams
D483,721 S 12/2003 Kim et al.
6,657,398 B2 12/2003 Chang
6,666,734 B2 12/2003 Fukatsu
6,672,750 B1 1/2004 Kao
D486,385 S 2/2004 Smith-Kielland et al.
6,733,167 B1 5/2004 Kao
6,752,512 B2 6/2004 Pan
6,774,549 B2 8/2004 Tsai et al.
6,794,825 B1 9/2004 Kao
6,805,463 B2 10/2004 Shieh
6,824,293 B2 11/2004 Chang
6,830,358 B2 12/2004 Allen
6,840,655 B2 1/2005 Shen
6,840,802 B2 1/2005 Shepherd
6,866,394 B1 3/2005 Hutchins et al.
6,869,316 B2 3/2005 Hinkle et al.
6,883,951 B2 * 4/2005 Wu ..... 362/565
6,884,083 B2 4/2005 Shepherd
6,908,215 B2 6/2005 Wu
6,929,383 B1 8/2005 Janning
D509,797 S 9/2005 Milan
6,942,355 B1 9/2005 Castiglia
6,951,405 B2 10/2005 Yao
6,962,498 B2 11/2005 Kohen
7,014,352 B2 3/2006 Wu
7,021,598 B2 4/2006 Kao
7,029,145 B2 4/2006 Frederick
7,045,965 B2 5/2006 Li et al.
7,052,156 B2 5/2006 Primeau
7,055,980 B2 * 6/2006 Wu ..... 362/123
7,055,981 B2 6/2006 Yao
7,066,628 B2 6/2006 Allen
7,066,739 B2 6/2006 McLeish
7,108,514 B2 9/2006 Chen et al.

(56) References Cited

U.S. PATENT DOCUMENTS

D530,277 S 10/2006 Lin
7,132,139 B2 11/2006 Yang
7,144,610 B1 12/2006 Estes et al.
7,145,105 B2 12/2006 Gaulard
7,147,518 B2 12/2006 Marechal et al.
7,192,303 B2 3/2007 Kohen
7,204,720 B1 4/2007 Shiu
7,207,844 B2 4/2007 Peng
7,235,815 B2 6/2007 Wang
7,253,556 B1 8/2007 Gibboney
7,253,714 B1 8/2007 Tsui
7,264,392 B2 9/2007 Massabki et al.
7,270,450 B2 9/2007 Chan
7,311,566 B2 12/2007 Dent
7,315,692 B2 1/2008 Chow
7,318,744 B2 1/2008 Kuo
7,326,091 B2 2/2008 Nania et al.
7,393,019 B2 7/2008 Taga et al.
7,422,489 B1 9/2008 Tseng
D580,355 S 11/2008 Hussaini et al.
7,445,824 B2 11/2008 Leung et al.
7,453,194 B1 11/2008 Gibboney
D582,846 S 12/2008 Lett
7,462,066 B2 12/2008 Kohen
D585,384 S 1/2009 Andre et al.
7,473,024 B2 1/2009 Gibboney
7,527,508 B1 5/2009 Lee et al.
7,554,266 B1 6/2009 Chen
D598,374 S 8/2009 Sasada
7,575,362 B1 8/2009 Hsu
7,581,870 B2 9/2009 Massabki et al.
7,585,187 B2 9/2009 Daily et al.
7,585,552 B2 9/2009 Meseke
7,609,006 B2 10/2009 Gibboney
D608,685 S 1/2010 Krize
7,652,210 B2 1/2010 White
D609,602 S 2/2010 Krize
D611,409 S 3/2010 Green et al.
7,695,298 B2 4/2010 Arndt et al.
D620,836 S 8/2010 Chen et al.
7,893,627 B2 2/2011 Li
D638,355 S 5/2011 Chen
8,007,129 B2 8/2011 Yang
8,053,042 B1 11/2011 Loomis
8,062,718 B2 11/2011 Schooley
8,100,546 B2 1/2012 Lutz et al.
8,132,360 B2 3/2012 Jin et al.
8,132,649 B2 3/2012 Rogers
8,298,633 B1 10/2012 Chen
8,348,466 B2 1/2013 Plumb et al.
D678,211 S 3/2013 Chen
8,450,950 B2 5/2013 McRae
8,469,734 B2 6/2013 Chen
8,469,750 B2 6/2013 Chen
D686,523 S 7/2013 Chen
8,534,186 B2 9/2013 Glucksman et al.
8,569,960 B2 10/2013 Chen
8,573,548 B2 11/2013 Kuhn et al.
D696,153 S 12/2013 Chen
8,863,416 B2 10/2014 Leung et al.
8,916,242 B2 12/2014 Fu et al.
8,959,810 B1 2/2015 Leung et al.
2002/0002015 A1 1/2002 Mochizuki et al.
2002/0097573 A1 7/2002 Shen
2002/0109989 A1 8/2002 Chuang
2002/0118540 A1 8/2002 Ingrassia
2002/0149936 A1 10/2002 Mueller et al.
2003/0096542 A1 5/2003 Kojima
2003/0142494 A1 7/2003 Ahroni
2003/0198044 A1 10/2003 Lee
2003/0198048 A1 10/2003 Frederick
2003/0206412 A1 11/2003 Gordon
2003/0218412 A1 11/2003 Shieh
2004/0004435 A1 1/2004 Hsu
2004/0012950 A1 1/2004 Pan
2004/0090770 A1* 5/2004 Primeau ..... 362/123
2004/0096596 A1 5/2004 Palmer, III et al.
2004/0105270 A1 6/2004 Shieh
2004/0115984 A1 6/2004 Rudy et al.
2004/0145916 A1 7/2004 Wu
2004/0161552 A1 8/2004 Butts, Jr.
2004/0257799 A1* 12/2004 Yao ..... 362/123
2005/0048226 A1 3/2005 Gary et al.
2005/0077525 A1 4/2005 Lynch et al.
2005/0122723 A1 6/2005 Frederick
2005/0249891 A1 11/2005 Kitamura et al.
2005/0249892 A1 11/2005 Rocheleau
2005/0286267 A1 12/2005 Wang
2006/0000634 A1 1/2006 Arakawa
2006/0048397 A1 3/2006 King et al.
2006/0146578 A1 7/2006 Kuo
2006/0164834 A1 7/2006 Kao
2006/0270250 A1 11/2006 Allen
2006/0274556 A1 12/2006 Massabki et al.
2007/0091606 A1* 4/2007 Reed ..... F21S 4/10
362/249.16
2007/0092664 A1 4/2007 Chun
2007/0147028 A1* 6/2007 Chan ..... 362/123
2007/0177402 A1 8/2007 Wu
2007/0230174 A1* 10/2007 Hicks et al. ..... 362/252
2007/0253191 A1 11/2007 Chin et al.
2008/0007951 A1 1/2008 Chan
2008/0025024 A1 1/2008 Yu
2008/0107840 A1 5/2008 Leung et al.
2008/0149791 A1 6/2008 Bradley
2008/0186731 A1 8/2008 Graham
2008/0186740 A1 8/2008 Huang et al.
2008/0205020 A1 8/2008 Vich
2008/0296604 A1 12/2008 Chou et al.
2008/0303446 A1 12/2008 Ding
2008/0307646 A1 12/2008 Zaderej et al.
2009/0002991 A1 1/2009 Huang
2009/0023315 A1 1/2009 Pfeiffer
2009/0059578 A1 3/2009 Lau
2009/0213620 A1 8/2009 Lee
2009/0260852 A1 10/2009 Schaffer
2009/0289560 A1 11/2009 Oliva
2010/0000065 A1 1/2010 Cheng et al.
2010/0053991 A1 3/2010 Boggs
2010/0067242 A1 3/2010 Fung
2010/0072747 A1 3/2010 Krize
2010/0099287 A1 4/2010 Colburn et al.
2010/0136808 A1 6/2010 Vanzo
2010/0159713 A1 6/2010 Nishihira et al.
2010/0195332 A1 8/2010 Wasem
2010/0196628 A1 8/2010 Shooley
2010/0263911 A1 10/2010 Watanabe
2011/0062875 A1 3/2011 Altamura
2011/0076425 A1 3/2011 Cheng et al.
2011/0215368 A1 9/2011 Chen
2011/0256750 A1 10/2011 Chen
2011/0286223 A1 11/2011 Chen
2011/0303939 A1 12/2011 Chen
2011/0305022 A1 12/2011 Chen
2012/0009360 A1 1/2012 Fu et al.
2012/0075863 A1 3/2012 Chen
2012/0076957 A1* 3/2012 Chen ..... 428/8
2012/0236546 A1 9/2012 Chen
2013/0059094 A1 3/2013 Chen
2013/0108808 A1 5/2013 Leung et al.
2013/0301246 A1 11/2013 Chen
2013/0301247 A1 11/2013 Chen
2013/0308301 A1 11/2013 Chen
2013/0309908 A1 11/2013 Sandoval et al.
2014/0049168 A1 2/2014 Chen
2014/0049948 A1 2/2014 Chen
2014/0087094 A1 3/2014 Leung et al.
2014/0215864 A1 8/2014 Fischer, Jr. et al.
2014/0268689 A1 9/2014 Chen
2014/0287618 A1 9/2014 Chen
2014/0334134 A1* 11/2014 Loomis ..... 362/123
2015/0029703 A1 1/2015 Chen

(56) References Cited

U.S. PATENT DOCUMENTS

| | | | |
|---|---|---|---|
| 2015/0070878 | A1 | 3/2015 | Yu |
| 2015/0157159 | A1 | 6/2015 | Leung et al. |
| 2015/0272250 | A1 | 10/2015 | Chen |

FOREIGN PATENT DOCUMENTS

| | | | |
|---|---|---|---|
| CN | 2242654 | Y | 12/1996 |
| CN | 1181693 | | 5/1998 |
| CN | 2332290 | | 8/1999 |
| CN | 2484010 | Y | 4/2002 |
| CN | 1509670 | | 7/2004 |
| CN | 2631782 | Y | 8/2004 |
| CN | 2751226 | Y | 1/2006 |
| CN | 100409504 | C | 9/2007 |
| CN | 100409506 | C | 8/2008 |
| CN | 200187701 | | 1/2009 |
| CN | 201829727 | U | 5/2011 |
| CN | 102224645 | A | 10/2011 |
| DE | 8436328 | | 4/1985 |
| DE | 102 35 081 | A1 | 2/2004 |
| EP | 434425 | A1 | 6/1991 |
| EP | 0552741 | | 7/1993 |
| EP | 0342050 | B1 | 8/1995 |
| EP | 0727842 | | 8/1996 |
| EP | 895742 | B1 | 2/1999 |
| EP | 0920826 | A1 | 6/1999 |
| EP | 1 049 206 | A2 | 11/2000 |
| EP | 1763115 | A2 | 3/2007 |
| EP | 2533374 | A1 | 12/2012 |
| FR | 1215214 | | 4/1960 |
| GB | 1150390 | | 4/1969 |
| GB | 1245214 | | 9/1971 |
| GB | 2112281 | A | 7/1983 |
| GB | 2 137 086 | A | 10/1984 |
| GB | 2 169 198 | A | 7/1986 |
| GB | 2172135 | | 9/1986 |
| GB | 2178910 | A | 2/1987 |
| GB | 2208336 | A | 3/1989 |
| GB | 2221104 | A | 1/1990 |
| GB | 2396686 | | 6/2004 |
| JP | 11121123 | A | 4/1999 |
| WO | WO 91/10093 | | 7/1991 |
| WO | WO 96/24966 | | 9/1996 |
| WO | WO9626661 | A1 | 9/1996 |
| WO | WO 2004/008581 | A1 | 1/2004 |
| WO | WO 2007140648 | A1 | 12/2007 |
| WO | WO 2009/115860 | A1 | 9/2009 |

OTHER PUBLICATIONS

Application and File History for U.S. Appl. No. 13/461,432, filed May 1, 2012, inventor Chen.
Application and File History for U.S. Appl. No. 13/718,028, filed Dec. 18, 2012 inventor Chen.
Application and File History for U.S. Appl. No. 13/962,084, filed Aug. 8, 2013, inventor Johnny Chen.
Application and File History for U.S. Appl. No. 12/157,136, filed Jun. 5, 2008, inventor Johnny Chen.
Application and File History for U.S. Appl. No. 90/012,209, filed Mar. 24, 2012, inventor Johnny Chen.
Application and File History for U.S. Appl. No. 13/710,003, filed Dec. 10, 2012, inventor Chen.
Application and File History for U.S. Appl. No. 14/171,429, filed Feb. 3, 2014, inventor Johnny Chen.
Application and File History for U.S. Appl. No. 13/112,650, filed May 20, 2011, inventor Chen.
Application and File History for U.S. Appl. No. 13/112,749, filed May 20, 2011, inventor Chen.
Application and File History for U.S. Appl. No. 12/157,136, filed Jun. 5, 2008 inventor Wu et al.
Application and File History for U.S. Appl. No. 90/012,209, filed Mar. 26, 2012 inventor Yao.
Image File Wrapper for U.S. Appl. No. 90/020,074, filed Jul. 14, 2014, U.S. Pat. No. 8,454,187.
Image File Wrapper for U.S. Appl. No. 90/020,073, filed Jul. 7, 2014, U.S. Pat. No. 8,454,186.
Image File Wrapper for Petition for *Inter Partes* Review of U.S. Pat. No. 8,454,187, Case No. IPR2014-01264, filed Aug. 8, 2014.
Image File Wrapper for Petition for *Inter Partes* Review of U.S. Pat. No. 8,454,186, Case No. IPR2014-01263, filed Aug. 8, 2014.
Image File Wrapper for U.S. Appl. No. 14/851,148, filed Sep. 11, 2015, Inventor Johnny Chen.
Image File Wrapper for U.S. Appl. No. 14/970,118, filed Dec. 15, 2015, Inventor Johnny Chen.
Petition for Inter Partes Review, Case IPR2016-00802, U.S. Pat. No. 9,044,056, dated Apr. 28, 2016 (73 pgs.).
Petition for Inter Partes Review, Case IPR2016-00801, U.S. Pat. No. 8,454,187 dated Apr. 18, 2016 (69 pgs.).
Petition for Inter Partes Review, Case IPR2016-00800, U.S. Pat. No. 8,454,186 (78 pgs.).

* cited by examiner 422
438
436
422
422
422
438
436
422
434
432
430
438
422
434
430
422
444
448
442
450
459
446
440
454
452
468
432
440
459
446
458

MODULAR LIGHTED ARTIFICIAL TREE

RELATED APPLICATION

This application is a continuation of U.S. patent application Ser. No. 13/710,003, filed Dec. 10, 2012, and claims the benefit of U.S. Provisional Application No. 61/568,926 filed Dec. 9, 2011, both of which are incorporated herein in their entireties by reference.

TECHNICAL FIELD

The present invention relates generally to modular, lighted artificial trees. More particularly, the present invention relates to lighted artificial trees with improved trunk electrical connectors, wiring harnesses and light string connectors and light strings.

BACKGROUND

Consumers have been putting lights on both live and artificial trees for generations. Over time, artificial trees have become increasingly popular for both convenience and safety reasons. Initially, consumers draped their trees in traditional, stand-alone light strings, making electrical connections between multiple sets of light strings, often creating a web of interconnected wires and lights. Eventually, manufacturers of artificial trees began offering artificial trees with light strings already clipped to the branches of the trees. While such "pre-lit" or lighted trees provide improvements over prior, non-lighted artificial trees, a consumer still generally must first assemble their artificial tree, then plug the various attached light strings together such that all lights receive power.

Further, as lighted trees become larger and more popular, more and more light strings are added to such pre-lit trees. The increased number of light strings, lights, and wiring adds weight to the tree, increases complexity of electrical connection, increases costs to consumers and manufactures, and often results in unsightly groupings of power plugs and wires. Such side effects of increasing the number of lights on an artificial tree significantly detract from the improved aesthetics resulting from the increased light density of the tree.

SUMMARY

Embodiments of the claimed invention improve upon known lighted, artificial trees.

An embodiment of the claimed invention includes a modular, lighted artificial tree that includes: a base portion for supporting the artificial tree and a first tree portion. The first tree portion including: trunk portion having a first end and a second end, and forming a trunk wall, the trunk wall defining a trunk cavity and a plurality of apertures, the first end of the trunk portion configured to couple with the base portion, a plurality of branches coupled to the trunk portion, and a first tree portion power-supply wiring harness within the trunk cavity and extending from the first end of the trunk portion to the second end of the trunk portion, the wiring harness having a first power supply wire and a second power supply wire; and a first light string operably coupled to the power-supply wiring harness, the first light string having a plurality of light element assemblies and a plurality of wire segments, the first light string defining a first end and a second end, the first end including a first wire, the second end including a second wire; and wherein the first wire and the second wire pass through a common one of the plurality of apertures to electrically connect to the wiring harness.

Another embodiment of the claimed invention comprises an artificial tree that includes a base portion for supporting the artificial tree, the base portion defining a trunk receiver, and a first tree portion. The first tree portion includes: a trunk portion having an upper end and a lower end, and forming a trunk wall, the trunk wall defining a trunk cavity, a wire-harness exit aperture, and a wire-harness entrance aperture, the lower end of the trunk portion configured for insertion into the trunk receiver of the base portion, a plurality of branches coupled to the trunk portion, and a first tree portion wiring harness including a first end portion, an intermediate portion, and a second end portion, wherein the first end portion and the second end portion are substantially enclosed within the trunk cavity, and the intermediate portion exits the trunk cavity through the wire-harness exit aperture and enters the trunk cavity through the wire-harness entrance aperture, such that at least a portion of the intermediate portion is outside the trunk cavity. The lighted artificial tree also includes a first light string operably coupled to the at least a portion of the intermediate portion of the first tree portion wiring harness, and a power cord for receiving electrical energy from an external power source and transmitting the electrical energy to the first tree portion wiring harness and the first light string.

In yet another embodiment, the claimed invention comprises a modular, lighted artificial tree, that includes a first tree portion including: a trunk portion having an first end and a second end, and forming a trunk wall, the trunk wall defining a trunk cavity, a plurality of branches coupled to the trunk portion, and a first tree portion power supply wiring harness including a distribution hub, a power supply connector assembly at the second end of the trunk, the power distribution hub receiving a first plurality of power transmission wires and a second plurality of power transmission wires, the first plurality of power transmission wires electrically connected to the second plurality of power transmission wires, and wherein second plurality of power transmission wires comprises a greater number of wires power transmission wires as compared to the first plurality of power transmission wires. The first tree portion also includes a first light string configured to electrically connect to the power supply wiring harness.

In yet another embodiment, the claimed invention comprises method of manufacturing a modular, lighted artificial tree that includes a first tree portion having a power-supply wiring harness inside a trunk of the tree that extends from a first end of the tree to the second end of the tree, and a light string. The method includes the steps of: inserting the power-supply wiring harness inside a trunk cavity of the trunk of the first tree portion; securing a first power supply electrical connection assembly at a first end of the trunk and a second power supply electrical connection assembly at a second end of the trunk; inserting a lead wire of the light string through an aperture in a side wall of the trunk; inserting a return wire of the light string through the aperture in the side wall of the trunk; electrically connecting the lead wire to a first power transmission wire of the power-supply wiring harness; and electrically connecting the return wire to a second power transmission wire of the power supply wiring harness.

Embodiments of the lighted trees, wiring systems, light strings and electrical connection systems of the claimed invention provide a number of advantages over the prior art and provide a number of benefits to both consumers and manufacturers.

From a consumer perspective, the modular, lighted tree of the claimed invention provides easy assembly via a unitary system of making mechanical and electrical connections between tree trunk sections or tree portions. A single power cord plugged into an external power source provides power to all tree portions and light strings. There is no need for a consumer or user to plug multiple light strings together to power the tree lights, thereby eliminating unsightly and inconvenient stacking of power plugs.

Embodiments of the claimed invention also provide increased safety to users. Because the tree is generally completely pre-wired, a user cannot accidentally connect too many light strings together, overtaxing the wires of the light strings. Further, secure connections between light strings and along main wires eliminate loose wires that could result in accidental shocks or even electrical arcing and fires.

From a manufacturing perspective, manufacturing efficiency may be increased while defects may be decreased. Unipolar couplers provide secure connections without soldering, twisting, or piercing wires. Some embodiments also reduce the number of connection points of light strings to power wires. A combination internal/external power supply wiring harness shields main wires and connectors by keeping some portions inside the trunk cavity. This allows easy access to main wiring by having main wires exit the trunk at intermediate points for connections to light strings, without interfering with branch-holder rings or branches.

BRIEF DESCRIPTION OF THE DRAWINGS

The invention may be more completely understood in consideration of the following detailed description of various embodiments of the invention in connection with the accompanying drawings, in which.

Figure 1:
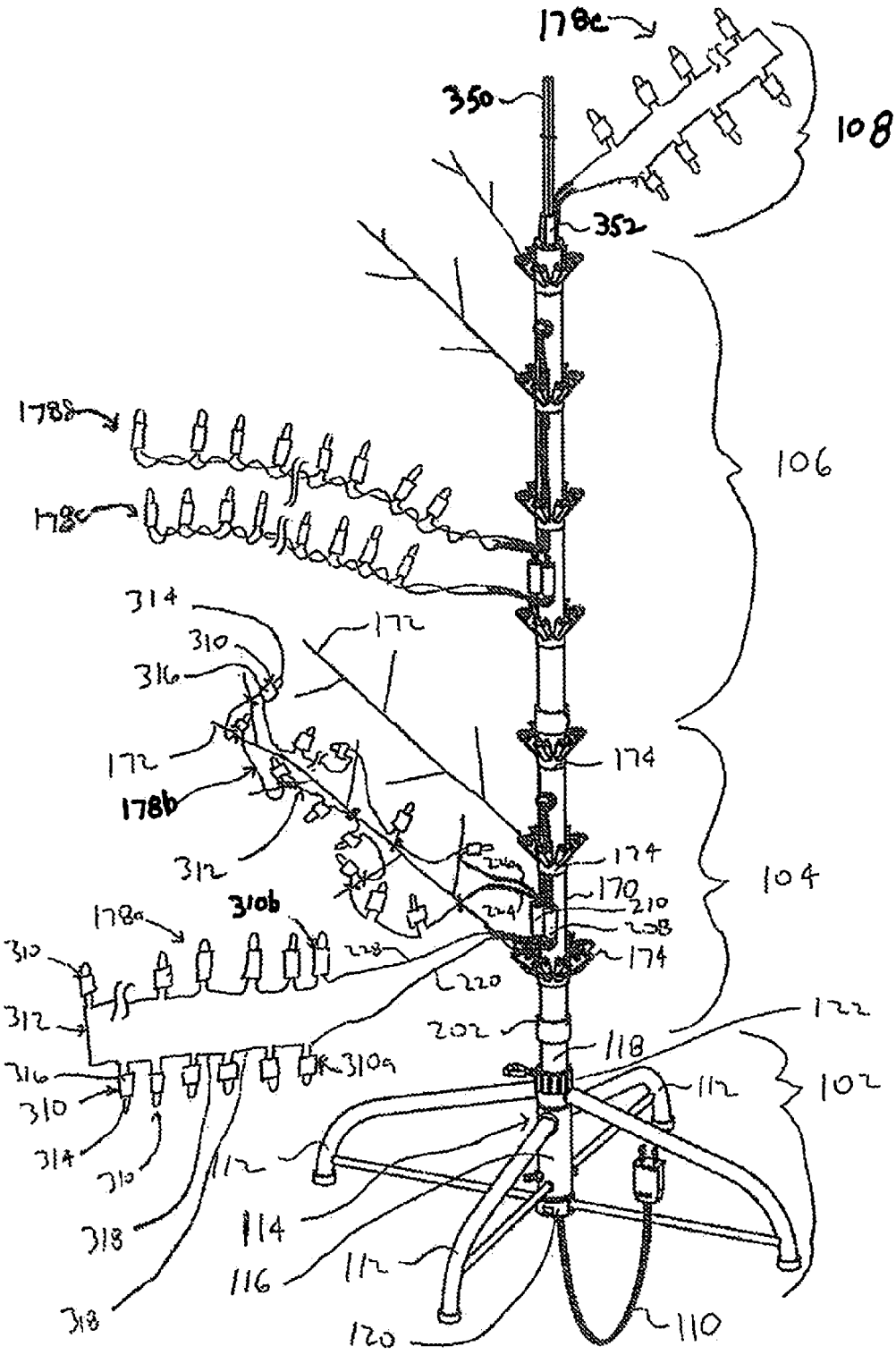
FIG. 1 is a front, perspective view of a lighted artificial tree with unipolar, light-string couplers, according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Embodiments of the present invention include, but are not limited to lighted artificial trees, wiring harness systems, light string couplers and various systems and methods for manufacturing and using same. It will be understood that the term "lighted" artificial tree refers to an artificial tree that includes light strings having elements that are capable of emitting light when powered. It will also be understood that the use of terms describing relative position or orientation, such as "upper", "lower", "vertical", "horizontal", and so on, are not intended to limit embodiments of the present invention.

Referring to FIG. 1, an embodiment of a modular, lighted artificial tree 100 having a portion of its power-supply wiring harness located outside the tree trunk, is depicted. As depicted, lighted artificial tree 100 includes base portion 102, first tree portion 104, second tree portion 106, tree-top portion 108, and power cord assembly 110. In some embodiments, lighted artificial tree 100 may only include a single tree portion, such as first tree portion 104, rather than multiple tree portions. In other embodiments, lighted artificial tree 100 may include more than three tree portions.

Figure 2:
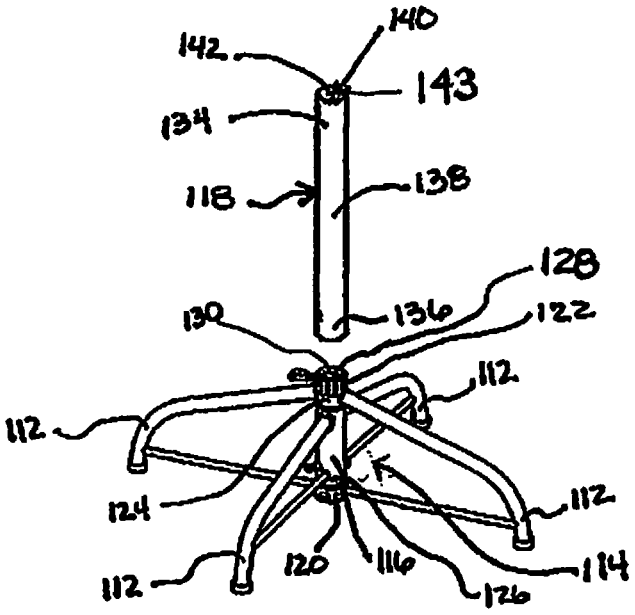
FIG. 2 is a partial exploded view of a wiring harness and a base of the lighted artificial tree of FIG. 1, according to an embodiment of the present invention.

Referring also to FIG. 2, base portion 102 in the embodiment depicted includes multiple base support portions, or legs, 112 attached to central support assembly 114. Central support assembly 114 in an embodiment includes base body 116, base-trunk portion 118, optional lower collar 120, and optional upper collar 122.

Base body 116 may be generally cylindrical as depicted, defining a generally circular cross section. In other embodiments, base body 116 may be less cylindrical and more block-like, and in some cases comprising non-circular cross-sectional shapes such as a square, hexagon, octagon, and so on. Base body 116 includes upper end 124, lower end 126, and defines inside cavity 124 with upper aperture 126.

Base-trunk portion 118, in an embodiment, includes upper end 134, lower end 136, and outer wall 138. Outer wall 138 defines base-trunk cavity 140 with upper base-trunk aperture 142 and may present projection or key 143 (see also FIGS. 5*a* and 5*b*).

When present, upper collar 122 is fit onto upper end 124 of base body 116 to assist in receiving and securing base-trunk portion 118. Lower collar 120, when present, may be fit onto lower end 126 of base body 116.

When assembled, lower end 136 of base-trunk portion 118 is inserted through upper aperture 126 of base body 116 and partially into cavity 124 of base body 116. In alternate embodiments, base body 116 and base-trunk portion 118 may be integral, or be coupled by other means.

Legs 112 may attach directly to base body 116 as depicted, or to other portions of central support assembly 114.

Figure 3:
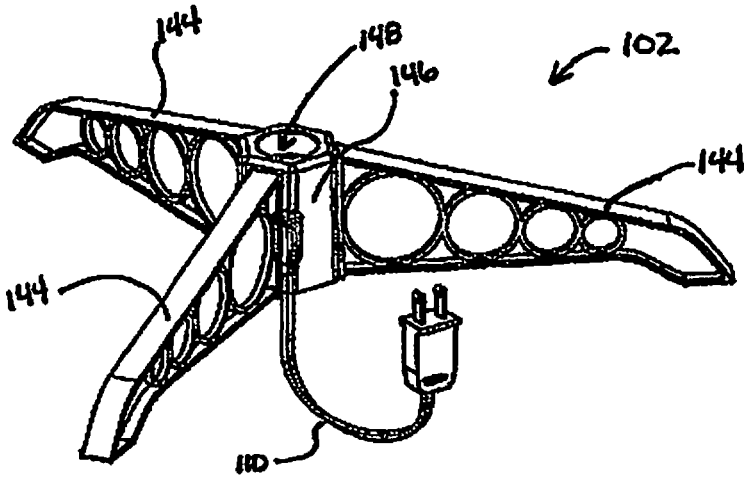
FIG. 3 is a front, perspective view of an alternate tree base of the lighted artificial tree of FIG. 1.

Referring to FIG. 3, an alternate embodiment of base portion 102 is depicted. In this embodiment, base portion 102 includes three legs 144, coupled to base body 146. Base body 146 comprises a generally cylindrical body having a hexagonal cross-section, and defining cavity 148. Cavity 148 is configured to receive a base-trunk portion (not shown), or other portion of a trunk of the lighted artificial tree.

In other alternate embodiments, base portion 102 may not include legs 144 (or legs 112), but rather comprise other structures, such as a block, pyramid, hemisphere, and so on, having a cavity for receiving a portion of a trunk of lighted artificial tree 100 and for supporting tree 100.

Figures 4, 5A, 5B:
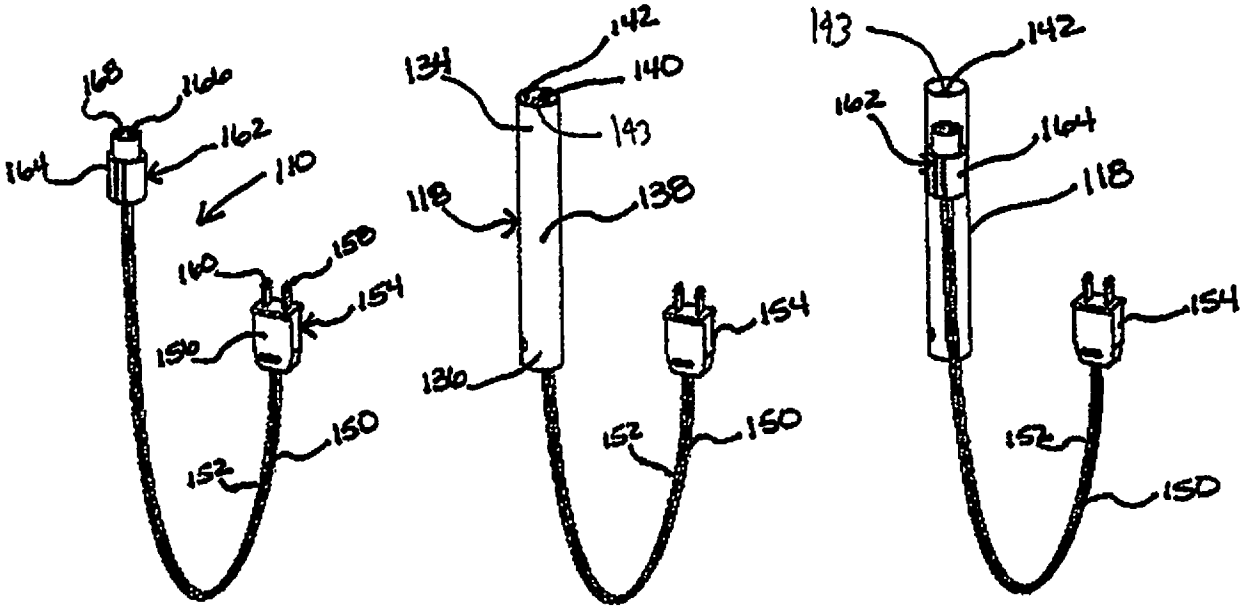
FIG. 4 is a front, perspective view of the power cord portion of the wiring harness of FIG. 2.
FIG. 5A is a front, perspective view of a power cord portion of a wiring harness of the tree of FIG. 1, according to an embodiment of the present invention, inserted into a base-trunk portion of the lighted artificial tree of FIG. 1.
FIG. 5B is a front, perspective view of the power cord portion of the wiring harness and the base-trunk portion of FIG. 5B, the base-trunk portion depicted as transparent.

Referring to FIGS. 4, 5A, and 5B, power cord assembly 110 with base-trunk portion 118 is depicted. Power cord assembly 110 in an embodiment includes first power cord transmission wire 150, second power cord transmission wire 152, and power plug 154. Each of first power cord transmission wire 150 and 152 include an inner conductor and an outer insulator. In some embodiments, as depicted, power cord assembly 110 also includes base power-supply connector 156 having first power wire contact 158 and second power wire contact 160.

Power plug 154 includes plug housing 156, first power plug contact 158 and second power plug contact 160. As depicted, first power plug contact 158 and second power plug contact 160 are blade-style contact terminals configured to fit into a socket or outlet of an external power source (not shown). In an embodiment, one of power plug contacts 158 or 160 comprises a relatively larger contact as compared to the other, such that power plug 154 is a polarized plug. In other embodiments, contacts 158 and 160 may comprise other shapes or prongs configured to fit into various styles of power outlets.

Plug housing 156 receives a portion of each of first power plug contact 158 and second power plug contact 158. Plug housing 156 also receives plug-end portions of first power cord transmission wire 150 and second power cord transmission wire 152. First power cord transmission wire 150 is electrically connected to first power plug contact 158 within plug housing 156. Second power cord transmission wire 150 is electrically connected to second power plug contact 160.

Base power-supply connector 162 is coupled to first power cord transmission wire 150 and second power cord transmission wire 152 at a base-trunk end of each respective wire. Base power-supply connector 162 includes plug housing 164, first base-trunk contact 166 and second base-trunk contact 168. First base-trunk contact 166 is in electrical connection with first power cord transmission wire 150; second base-trunk contact 168 is in electrical connection with second power cord transmission wire 152. Base power-supply connector 162 in an embodiment is similar to the connector depicted and described with respect to FIG. 8.

Referring specifically to FIGS. 5A and 5B, in an embodiment, base power-supply connector assembly 162 is sized to fit securely within an interior cavity 142 or space of base-trunk portion 118. In such an embodiment, a diameter of plug housing 164 at its largest point is approximately the same as an inside diameter of base-trunk portion 118, or slightly smaller, such that the outer wall of plug housing 164 in contact with an inside wall of base-trunk portion 118 forms a friction fit, thereby securing base power-supply connector 164 within base-trunk portion 118. In other embodiments, power-supply connector assembly 162 may be secured within base-trunk portion 118 by other means, including, but not limited, fasteners through the trunk portion wall and into the connector, and so on. Depending in part upon how far a trunk of lighted artificial tree 100 extends into base-trunk portion 118, base power-supply connector assembly 162 may be located generally near upper end 134 of base-trunk portion 118, rather than near bottom end 135 of base-trunk portion 118.

In other embodiments, tree 100 may not include a base portion 102, but rather, first tree portion 104 interfaces or couples with power cord assembly 110.

Figure 6:
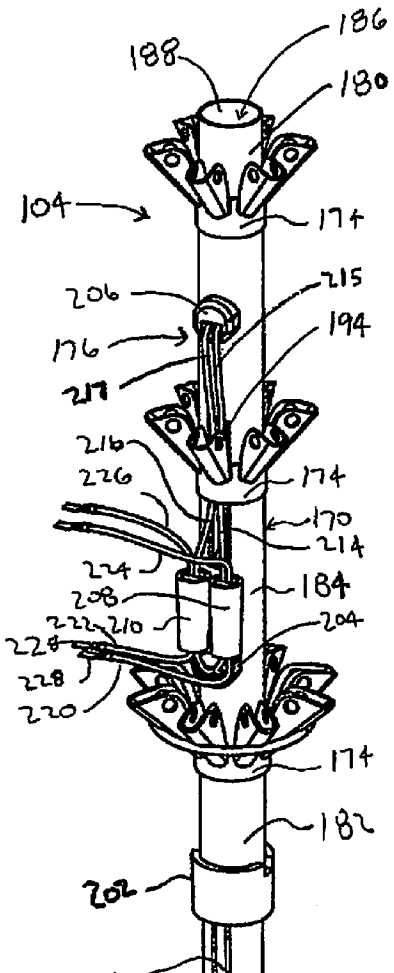
FIG. 6 is a front, perspective view of a first tree portion of the lighted artificial tree of FIG. 1.

Referring to FIGS. 1 and 6, an embodiment of first tree portion 104 is depicted. First tree portion 104 as depicted includes first trunk portion 170, one or more branches 172, one or more branch-support rings 174, power-supply wiring harness 176, and one or more light strings 178.

Figure 7:
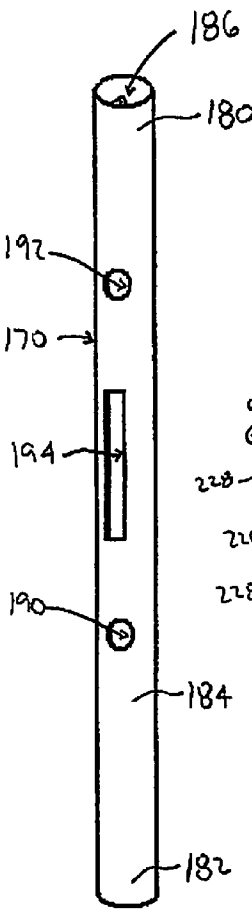
FIG. 7 is a front perspective view of a trunk body of the first tree portion of FIG. 6.

Referring also to FIG. 7, first trunk portion 170 includes upper end 180, lower end 182, and outer wall 184. Outer wall 184 defines cavity 186, the inside of first trunk portion 170, including upper end aperture 188. In various embodiments, first trunk portion 170 may also define wire-harness exit aperture 190, wire-harness entrance aperture 192, and wire guide channel 194. Wire guide channel 194, in an embodiment, forms an indentation in first trunk portion 170, but does not form an opening or hole in outer wall 184, thereby minimizing any structural support characteristics of wall 184. In other embodiments, wire guide channel 194 forms an opening or hole in outer wall 184.

As depicted, first trunk portion 170 comprises a generally cylindrical, thin-walled hollow tube. In other embodiments, trunk portion 170 may only be partially hollow, and rather than form a circular cross-section, may define other cross-sectional shapes, including square, hexagonal, octagonal, and so on. First trunk portion 170 may comprise a variety of materials, such as metal, plastic, a combination of metal and plastic, and other such rigid materials.

Figure 8:
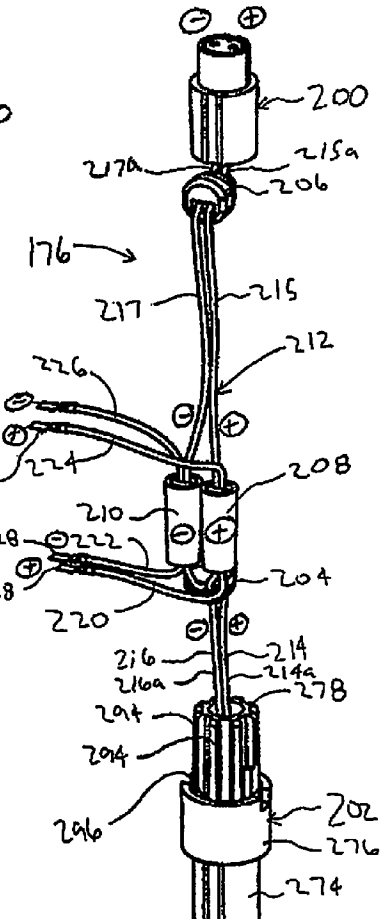
FIG. 8 is a front perspective view of a wiring harness assembly of the first tree portion of FIG. 6, according to an embodiment of the present invention.

Referring to FIG. 8, an embodiment of power-supply wiring harness 176 is depicted. Power-supply wiring harness 176 as depicted includes a first, or upper, trunk power-supply connector assembly 200, a second, or lower, power-supply connector assembly 202, optional exit plug 204, optional entrance plug 206, first light-string coupler 208, second light-string coupler 210, and first tree portion harness wire set 212. In an embodiment, second or lower power-supply connector assembly 202 not only is configured to function as an electrical connector, but in an embodiment is also is configured to provide mechanical support for coupling base 102 to tree portion 102, as described further below. In another embodiment, power-supply connector assembly 202 resembles power-supply connector assembly 200 and is inserted fully into lower trunk portion 182. In such an embodiment, first trunk portion 182 may engage with base trunk portion 118. In such an embodiment, a portion of first trunk portion 182 may be inserted into base trunk portion 118, or vice versa.

First tree portion harness wire set 212 includes a plurality of wires, including power transmission wires 214 and 215, first tree portion power transmission wires 216 and 217, first light string lead wire 220, first light string return wire 222, second light string lead wire 224, and second light string return wire 226. Each light string wire 220 to 226 may include conductive terminal 228. Further, each wire of first tree harness wire set 212 includes an inner conductive portion comprising stranded copper, copper alloy, nickel, or other such conductive material, as well as an outer insulator portion.

As will be explained in further detail below, first light string coupler 208 electrically and mechanically couples power transmission wires 214 and 215, first light string lead wire 220 and second light string lead wire 224, together. Similarly, second light string coupler 210 electrically and mechanically couples power transmission wires 216 and 217, first light string return wire 222 and second light string return wire 226. First light-string coupler 208 may be substantially the same as second light-string coupler 210.

Figure 9:
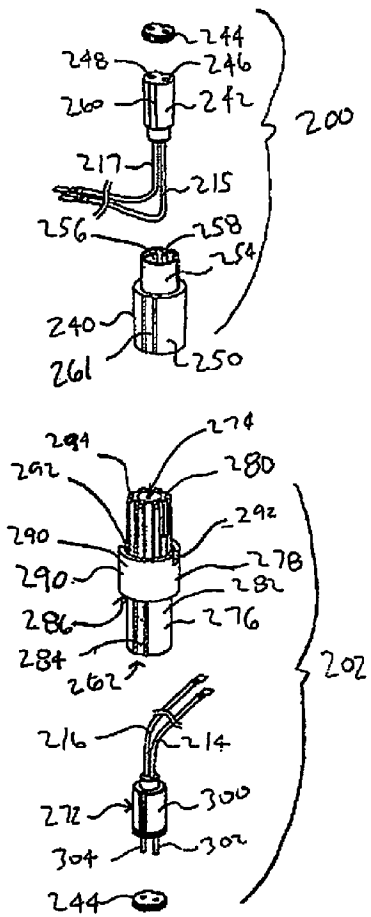
FIG. 9 is an exploded view of the trunk connectors of the wiring harness assembly of FIG. 8.

Referring also to FIG. 9, exploded illustrations of power-supply connector assembly 200 and lower power-supply connector assembly 202 are depicted.

In the embodiment depicted, power-supply connector assembly 200 may be substantially the same as base power-supply connector assembly 162, and includes body or housing 240, contact support body 242 and optional disk 244. An end of first tree portion power transmission wire 215 is electrically connected to contact 246 at contact support body 242; an end of first tree portion power transmission wire 217 is electrically connected to contact 248 at contact support body 242. Contacts 246 and 248 may be recessed into contact support body 242, or in other embodiments, may form channels to receive complementary electrical contacts from second tree portion 106.

Housing 240 includes lower housing portion 250 and upper housing portion, and defines contact support body receiver 256. Lower housing portion 250 may be generally cylindrical or circular in cross-section in an embodiment, and is sized to fit securely within interior cavity 186 or space of first trunk portion 170 near upper end 180. In such an embodiment, a diameter of lower plug housing 250 at its largest point is approximately the same as an inside diameter of first trunk portion 170 such that the outer wall of lower housing portion 240 in contact with an inside wall of first trunk portion 170 forms a friction fit, thereby securing power-supply connector assembly 200 within first trunk portion 170. Other means of securing housing 240 within first trunk portions 170 may alternately be used, such as those described above with respect to power-plug assembly 110.

Upper housing portion 254 in an embodiment may comprise a smaller diameter as compared to lower housing portion 250, such that upper housing portion 254 may not contact an inner wall of first trunk portion 170.

In an embodiment, an inner wall of housing 240 may present a key or ridged projection 258 that fits into a complementary guide slot or channel 260 of contact support body 242 to properly orient contact support body 242 and contacts 246 and 248 within housing 240. Similarly, housing 240 may define guide channel 261 on an outside wall. Guide channel 262 may receive a complementary projection, ridge, or other sort of key within trunk portion 170 so as to orient or align power-supply connector assembly 200 in first trunk portion 170. As discussed further below, such keying assists with the alignment of first and second trunk portions 104 and 106 such that secure mechanical and electrical connections are made.

In other embodiments, housing 240 and corresponding structure are not keyed. In such an embodiment, connectors 200 and 202 may otherwise be located and secured in their respective trunk ends. In one such embodiment, connectors 200 and 202 include locating apertures (not depicted) to receive a pin that extends through the trunk wall to secure the connectors.

Lower power-supply connector assembly 202 includes lower trunk support plug 262, lower male plug assembly 272, and insulating and support disk 244, and defines through cavity 274.

Lower trunk support plug 262 includes lower portion 276, middle portion 278 and upper portion 280. Lower portion 276 in an embodiment includes generally cylindrical outer wall 282 which may define a guide channel 284. Lower trunk support plug 262 is generally sized to fit into a top portion of base-trunk portion 118, thereby securing first tree portion 104 to base portion 102 (see also FIG. 1). Guide channel or keyway 284 in an embodiment receives a projection or key (not depicted) presented by an inside wall of upper portion 134 of base-trunk portion 118 so as to align first tree portion 104 with base portion 102 such that secure mechanical and electrical connections are made between the two portions.

Intermediate portion 278 includes generally cylindrical wall 290 and orthogonal wall 286. Orthogonal wall 286 is configured to contact a top portion of base-trunk portion 118 when first tree portion 104 is inserted into base portion 102. Wall 290 may also define a cutout 290 or a pair of opposing cutouts 290 intended to receive a notch or projection (not depicted) of lower portion 182 first trunk portion 170 so as to align first trunk portion 170 relative to lower power-supply connector assembly 202.

Upper portion 280 comprises a generally cylindrical body. Upper portion 280 may include a plurality of vertically extending ridges or splines 294. Upper portion 280 is sized to fit inside cavity 186 at lower end 182 of first trunk portion 170, such that splines 294 contact an inside surface of lower end 182 of first trunk portion 170, thereby securing lower power-supply connector assembly 202 to first trunk portion 170.

Upper portion 280 and intermediate portion 278 define circular slot 296 between upper portion 280 and 278, sized to securely receive a portion of lower end 182 of first trunk portion 170. When assembled, an inside surface of intermediate portion 278 contacts an outside surface of lower portion 182 of first trunk portion 170 to aid in securing lower power-supply connector assembly 202 to first trunk portion 170.

Lower male plug assembly 272 is received into cavity 274 of lower support plug 262. Lower male plug assembly 272 includes plug body 300 securing first contact 302 and second contact 304. First contact 302 is in electrical contact with power transmission wire 214; second contact 304 is in electrical contact with first tree portion power transmission wire 216. Although plug assembly 272 is described as a male plug assembly, and plug 242 is depicted and described as a female-style plug, it will be understood that the various "plug" connectors depicted and described are illustrative only, and such plug connectors may comprise other structures for making electrical connections, including, but not limited to coaxial connectors, blade connectors, and so on.

Referring to FIGS. 6-8, when assembled, portions of power-supply wiring harness 176 reside within cavity 186 of first trunk portion 170 and other portions lie outside, and adjacent to, outer wall 184 of first trunk portion 170. More specifically, as described above, power-supply connector assembly 200 with adjacent portions 215*a* and 217*a* of wires 215 and 217 respectively reside within upper end 180 of first trunk portion 170. Lower power-supply connector assembly 202 couples to lower end 182 of first trunk portion 182, partially inside cavity 186, and partially outside. Wire portions 214*a* and 216*a* reside within cavity 186, while the remainder of wires 214 and 216 reside outside cavity 186 and adjacent wall 184.

Wires 214 and 216 exit first trunk portion 170 through wire-harness exit aperture 190 and exit plug 204, extending along first trunk portion 170 towards wire-harness entrance aperture 192, and when present, wire guide channel 194. Power transmission wires 215 and 217 extend away from their respective light string couplers 208 and 210 toward and through wire-harness entrance aperture 192 and entrance plug 206, and back into cavity 186 of first trunk portion 170.

When a branch support ring 174 is present, first trunk portion 170 may include wire guide channel 194. In such an embodiment, some wires of power-supply wiring harness 176 may be received into guide channel 194 such that the wires are routed under branch ring support 176 and adjacent wall 184. Such a feature enables more efficient manufacture of tree portion 104, while at the same time reducing the amount of wire required, and keeping the wires organized so as avoid wires being caught on pivoting branches. As depicted, wires 215 and 217 are received into guide channel 194, though in other embodiments, other wires, including wires 214 and 216 may be received by guide channel 194.

By locating portions of power-supply wiring harness 176 within cavity 186, primary power transmission connections remain hidden and are less accessible to a user of lighted artificial tree 100. Such a feature not only increases the external appearance of tree 100, but also reduces the possibility of accidental shock from a user touching live wires and connectors while lighted artificial tree 100 is powered. At the same time, by having portions of power-supply wiring harness 176 outside first trunk portion 170, easy connection to light strings 178 may be made for ease of manufacture.

Referring again to FIGS. 1 and 6, first lighted tree portion 104 also includes one or more light strings 178. As depicted, first lighted tree portion 104 includes two light strings 178. In other embodiments, first lighted tree portion 104 may include more or fewer light strings 178.

Each light string 178, including light string 178*a* and 178*b*, comprises a plurality of lighting element assemblies 310 and light string wire set 312. Each lighting element assembly 310 includes lighting element 314 and housing 316. Lighting element 314 may comprise an incandescent light bulb, light-emitting diode lamp, or other such devices capable of emitting light when powered. Lighting elements 314 may be configured to operate using alternating current (AC), or direct current (DC) power, and at various voltage and current ratings. For example, in one embodiment, each light string 178 includes 50 lighting elements 314 each rated at 2.5 VAC and 1.7 A.

Housing 316 may comprise any of a variety of housings for securing portions of wire set 312 to lighting elements 314, including housings, lamp holders, bulb adapters, and so on, assembled or molded onto lighting elements 314 and comprising materials including, but not limited to, polypropylene (PP), polyethylene (PE), polybutylene (PBT), silicone, and other various types of plastic material.

Wire set 312 includes individual wires or wire segments 318 connected to individual lighting element assemblies 310, as well as a lead wire and a return wire. The lead wire and return wire for each light string 178 also comprises a portion of power-supply wiring harness 176 as described above. Further, each lead wire is connected to one of a pair of power transmission wires of the power-supply wiring harness 176 by a light string coupler, and the return wire is connected to the other of a pair of power transmission wires of the wiring harness 176.

More specifically, the lead wire for light string 178*a* comprises first light string lead wire 220, while the return wire for light string 178*a* comprises first light string return wire 222. The lead wire for the second light string 178, light string 178*b*, comprises second light string lead wire 224, while the return wire for light string 178*b* comprises second light string return wire 226. Both lead wires 220 and 224 are thereby connected to power transmission wires 214 and 215, through first light string coupler 208. In an embodiment, power transmission wires 214 and 215 may be a "hot" or "live" current-carrying power transmission wire. Similarly, both return wires 222 and 226 are connected to power transmission wires 216 and 217 through light string coupler 210. In an embodiment, power transmission wires 216 and 217 may be a neutral or ground wire of a power transmission wire pair.

With their common electrical connections and conductive path back to contact 258 of power plug 154, and ultimately to a first pole of an external power source, lead wires 220 and 224 and power transmission wires 214 and 215 share the same electrical polarity. Similarly, with their common electrical connections and conductive path back to contact 260 of power plug 154, and ultimately to a second pole of an external power source, return wires 222 and 226 and power transmission wires 216 and 217 share the same electrical polarity. Hence, light string couplers 208 and 210 may be considered "unipolar" connectors or couplers. Further details of unipolar light string couplers 208 and 210 are discussed further below.

For example, for a direct-current (DC) powered lighted artificial tree 100, lead wires 220 and 224, coupler 208, and power transmission wires 214 and 216 may all be electrically connected to a positive pole of a DC power source, while return wires 222 and 226 with coupler 210 and power transmission wires 215 and 217 may all be electrically connected to the negative pole of the DC power source. Such a polarity configuration is illustrated in FIG. 8, with + symbols indicating connection to a first, or positive pole, and − symbols indicating connection to a second, or negative pole. It will be understood that lighted artificial tree may also be used with an alternating current (AC) power source. In such an embodiment, the various groups of wires and couplers will still maintain common polarity as described above, though it will be understood that one pole may alternate between positive and negative voltage as the AC voltage and current rises and falls with the output of the AC power source.

By connecting, or coupling, light strings 178 to power transmission wires of a power-supply wiring harness 176 using unipolar light-string couplers, light strings 178 cannot easily be accidentally "unplugged" within the artificial tree as is the case when a user must plug and unplug a standard, stand-alone light string between light strings and lighted tree sections of known lighted trees.

As depicted, each light string 178 comprises a series-connected light string, with first light string lead wire 220 connected to a "first" lighting element assembly 310*a* in the series of lighting element assemblies 310, and first light string return wire connected to a "last" lighting element assembly 310*b*. As such lighting element assemblies 310 are wired in electrical series. However, it will be understood that the embodiments of the invention are not limited to electrically-configured light strings 178. Rather, lighting element assemblies 310 may be electrically configured in parallel, series-parallel, or other electrical configurations.

Further, light strings 178 may comprise various types of wire sets 312. As depicted in FIG. 1, first light string 178*a* comprises a single-loop design wire set 312. Each lighting element assembly 310 receives an end of a single wire or wire segment 318. In such an embodiment, no additional wires, such as a return wire, are intertwined with, or twisted around, wires 318. Lighting element assemblies 310 are "daisy-chained" together forming a single-wire-loop configuration. When lead wire 220 and return wire 222 are attached to power-supply wiring harness 176 for installation into first trunk portion 170 prior to adding light strings 178, such a single-loop configured light string may be more easily attached to wiring harness 176 with lighting element assemblies more easily and attractively distributed about branches 172 (as compared to twisted-pair light string configurations as discussed further below). In an embodiment, a lead wire, such as lead wire 220 may be substantially the same length of a return wire, such as return wire 229. A single-wire-loop configuration also generally reduces the amount of wire required for a given lighting distribution as compared to a twisted-pair configuration (as described further below).

As depicted, in an embodiment, light strings 178, may comprise a single electrical circuit. In one such embodiment, and as described above, such a light string 178 may comprise a single set of series-connected lighting element assemblies 310. In such an embodiment, every housing 310 of light string 178 comprises a two-wire housing. In other words, only two wires, such as two wire segments 318, or a wire segment 318 plus a lead or return wire, are inserted into each housing 310. Light strings 178 comprising only two-wire housings 310 reduce manufacturing assembly and the number of parts required.

Consequently, a light string 178 comprising only two-wire housings 310 and having a single-wire-loop construction thusly provides multiple advantages over known light strings for trees, including improved manufacturing and aesthetic features.

Conversely, in a traditional light string use on lighted artificial trees, especially a parallel-series light string comprising two sets of series-connected lighting elements, each set connected in parallel to the other, a combination of three-wire housings and two wire housings are required (each first and last housing in a series circuit having a three-wire housing).

In another embodiment, light strings 178 may be a twisted pair configuration, such as light strings 178*c* and 178*d* of lighted tree portion 106. In such a configuration, a return wire or extension thereof, may be wound about each individual wire segment 318 such that a twisted pair of wires is "between" each lighting element assembly 310. The twisting of the return wire makes it more difficult for any wire 318 to be pulled out of its corresponding lighting element assembly 310.

In such an embodiment, return wire 228 may extend an entire length of twisted pair light string 178*c*, from power-supply wiring harness 176 to a "last" or furthest (relative wiring harness 176) light element assembly 310, while lead wire 220 extends less than the entire length of twisted pair light string 178*c*, or from wiring harness 176 to a "first" or closest light element assembly 310. In such an embodiment, return wire 228 is significantly longer than lead wire 220. In an embodiment, return wire 228 is more than twice as long as lead wire 220.

Conversely, in a single-wire loop construction, return wire 228 does not extend along an entire length of a light string 178. In an embodiment of a single-wire loop light string 178, such as light string 178*h*, a length of return wire 228 is substantially equal to a length of lead wire 220. In another embodiment, a length of return wire 228 is less than three times as long as a length of lead wire 220.

In yet another embodiment, light string 178 may be a variation of the single-loop and twisted pair designs. In such an embodiment, a light string 178 comprises a single-loop configuration, with the addition of a supporting strand SS twisted around, or intertwined with, wires 318 (see, also FIG. 25). Such a supporting strand SS may comprise a fibrous material such as a string, or a plastic or polymer material resembling a standard conductive wire without the conductive portion, or other such string-like support material.

Figure 11:
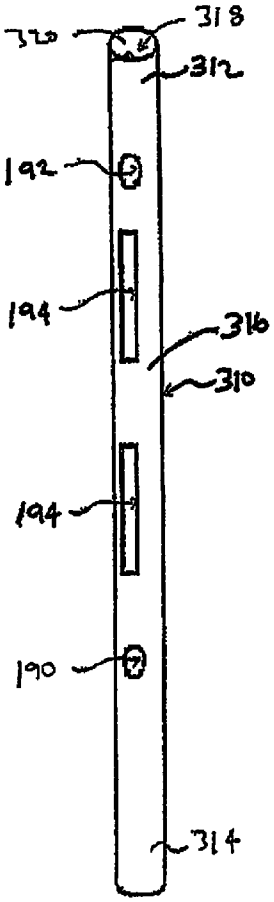
FIG. 11 is a front perspective view of a trunk portion of the second tree portion of FIG. 10.
Figure 10:
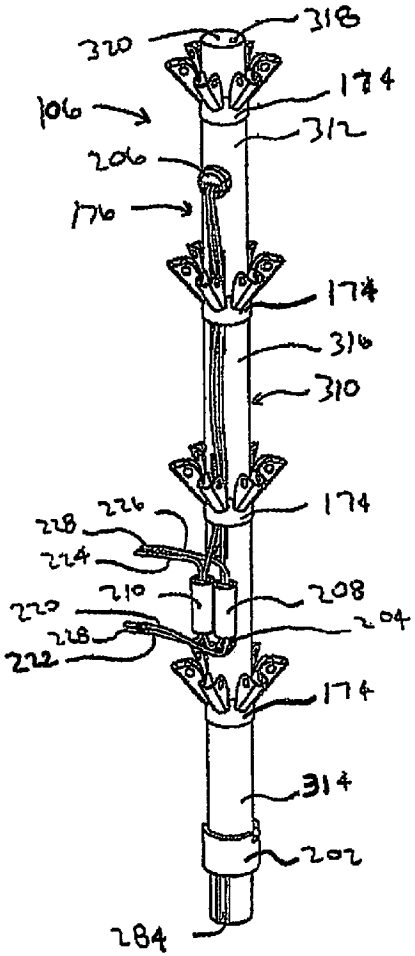
FIG. 10 is a front, perspective view of a second tree portion, including a wire harness of the lighted artificial tree of FIG. 1.

Referring to FIGS. 1, 10 and 11, second tree portion 106 is depicted. Second tree portion 106 in an embodiment is substantially the same as first tree portion 104. Second tree portion 106 may be longer or shorter than first tree portion, and include more or fewer branches 172, branch support rings 174, and light strings 178.

As such, second tree portion 106 includes second trunk portion 310, one or more branches 172, one or more branch-support rings 174, wiring harness 176, and one or more light strings 178.

Second trunk portion 310 includes upper end 312, lower end 314, and outer wall 316. Outer wall 316 defines cavity 318, the inside of first trunk portion 310, including upper end aperture 320. In various embodiments, first trunk portion 310 may also define wire-harness exit aperture 190, wire-harness entrance aperture 192, and one or more wire guide channels 194. In the embodiment depicted, second trunk portion 310 includes an upper and a lower wire guide channel 194 so that wires of power-supply wiring harness 176 may extend from aperture 190 to 192 beneath a pair of branch support rings 174.

As depicted, second lighted tree portion includes two light strings 178, or light string 178*c* and 178*d*, both depicted as twisted-pair light strings.

Power-supply wiring harness 176 of second tree portion 106, as mentioned above, is substantially the same as power-supply wiring harness 176 of first tree portion 104, and provides power to light strings 178*c* and 178*d*. However, in the embodiment of lighted tree portion 106, power-supply wiring harness 176 is somewhat longer in length to accommodate a slightly longer second trunk portion 310 (as compared to the slightly shorter first trunk portion 170). It will be understood that such variations may exist for different sizes of lighted tree portions.

Although a particular embodiment of a power-supply wiring harness 176 is depicted for first lighted tree portion 104 and second lighted tree portion 106, other embodiments of a wiring harness may be used with either first lighted tree portion 104 or second lighted tree portion 106.

Figure 12:
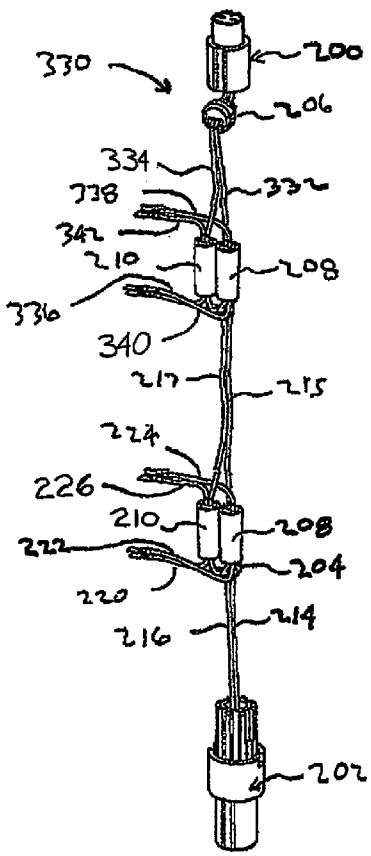
FIG. 12 is a front, perspective view of an alternate embodiment of the wiring harness assembly of FIG. 10.

Referring to FIG. 12, an alternate embodiment of a wiring harness, wiring harness 330 is depicted. Wiring harness 330 is substantially the same as power-supply wiring harness 176, with the exception of an additional pair of unipolar light string-connectors 208 and 210, and additional, associated wiring. The additional associated wiring includes intermediate power transmission wires 332 and 334, lead wires 336 and 338, and return wires 340 and 342. Power transmission wire 332 is electrically connected to power transmission wires 214 and 215, as well as lead wires 220, 224, 336, and 338. Power transmission wire 334 is electrically connected to power transmission wires 216 and 217, as well as return wires 222, 226, 340, and 342. The additional pair of unipolar light string-connectors 208 and 210 makes it possible for wiring harness 330 to power four light strings 178, rather than only the two light strings 178 of wiring harness 176. Lead wire 336 with return wire 340 provide power to a first additional light string 178 (not depicted), while lead wire 338 and return wire 342 provide power to a second additional light string 178 (not depicted).

In such a manner, a power-supply wiring harness 176 or 330 can be adapted by adding additional pairs of unipolar light-string connectors and wiring to add additional light sets.

Further, as described below, additional light strings may be added to a lighted tree portion, such as lighted tree portion 104 or 106, by employing alternate embodiments of unipolar light string couplers 208 and 210. Such alternate couplers 208 and 210 may couple more than four wires together.

Referring to FIG. 1 and FIGS. 13A to 13C, lighted tree-top portion 108 is depicted. Lighted tree-top portion 108 includes mast 350 (see FIG. 1), tree-top support connector 352, and one or more light strings 178, including light string 178*e*.

Lighted tree-top portion 108 may also include one or more branches 172. Branches 172 may be connected directly to mast 350. In other embodiments, lighted tree-top portion 108 does not include branches 172, but rather mast 350 includes artificial needles or other tree-like ornamental structure.

Light string 178*e* is mechanically attached to mast 350 and if present, branches 172 of lighted tree-top portion 108. Light string 178*e* is electrically connected to tree-top support connector 352.

Mast 350 as depicted comprises a pole-like structure extending upward and away from tree-top support connector 352. In an embodiment, mast 350 may comprise a hollow structure, while in other embodiments, mast 350 may comprise a solid structure. Mast 350 may further comprise materials including metal, plastic, and so on.

Figure 13C:
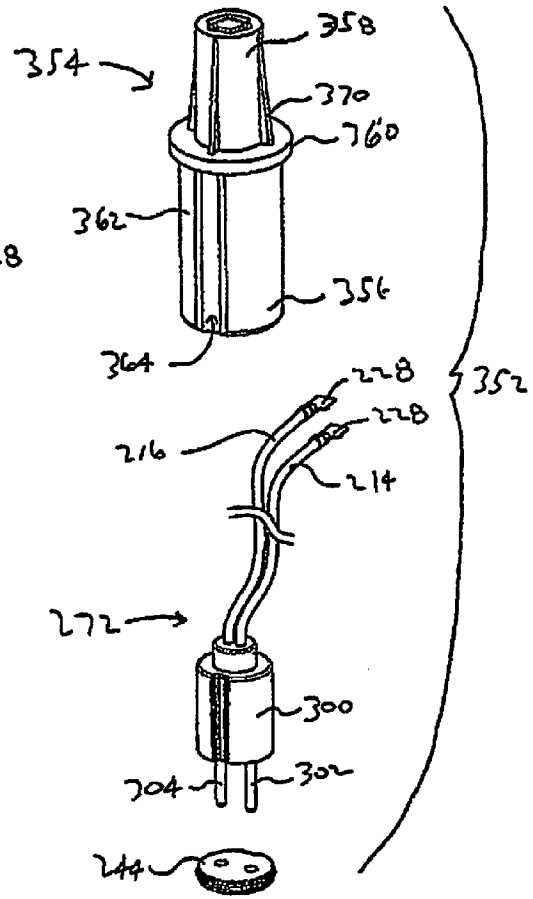
FIG. 13C is an exploded view of the connector of FIGS. 13A and 13B.
Figure 13B:
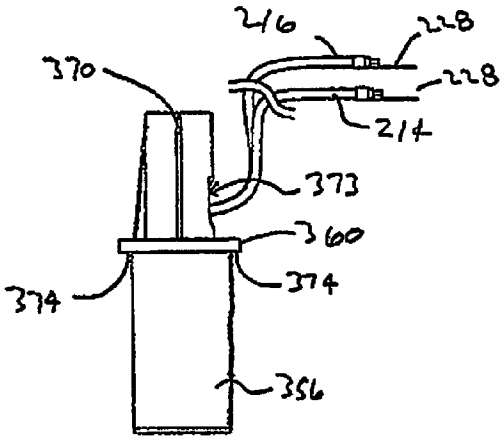
FIG. 13B is right side elevation view of the connector of FIG. 13A.
Figure 13A:
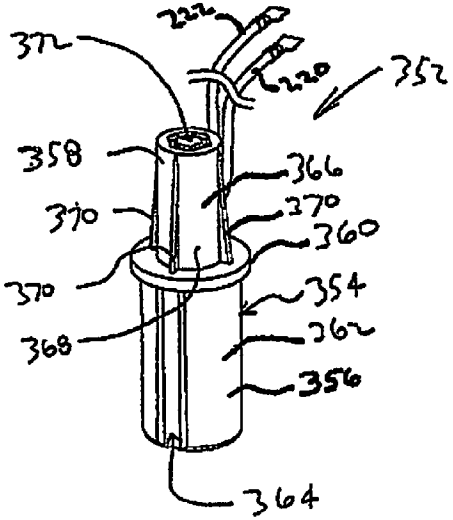
FIG. 13A is a front, perspective view of a connector of a third trunk portion of the lighted artificial tree of FIG. 1.

Referring specifically to FIGS. 13A to 13C, tree-top support connector 352 includes tree-top connector body 354 and connector assembly 272.

Tree-top connector body 354 includes generally cylindrical lower portion 356 joined to upper portion 358 at flange 360. Lower portion 356 includes outer wall 362. In an embodiment, outer wall 362 defines a channel or keyway 364. Body 354 is sized and configured to be inserted through upper aperture 320 and into cavity 318 of second trunk portion 310. In some embodiments, wall 316 of upper trunk portion 312 will present a key or projection configured to fit into keyway 364 so as to align tree-top support connector 352 in second lighted tree portion 106.

Upper portion 358 in the embodiment depicted includes mast-support portion 366 with wall 368, and supports 370. Mast-support portion 366 and wall 368 defines cavity 372, and side opening 373. Cavity 372 may extend downward into lower portion 356. A diameter of cavity 372 is sized to receive an end of mast 350. Supports 370 provide support to mast-support portion 366.

Flange 360 is located at the transition between lower portion 356 and upper portion 358. Flange 360 comprises an outer diameter that may be larger than an outside diameter of lower body 356 and includes lower flange surface 374. Lower flange surface 374 contacts, and is supported by, a top edge of upper trunk portion 312, when inserted into second trunk portion 310.

When assembled, male plug connector assembly fits into a lower portion of cavity 372 of lower portion 356, with wire 214, which serves as a light string lead wire in this configuration, and wire 216, which serves as a light string return wire, extending upward through cavity 372. A portion of wires 214 and 216 extend through side opening 373 such that they may be connected to light set 178*e*. An end of mast 350 is inserted into an upper portion of cavity 372 and supported in a generally vertical or upright position by upper portion 358.

Referring to FIGS. 1, 2, 6, and 10, when lighted artificial tree 100 is assembled, first lighted tree portion 104 is coupled to base portion 102; second lighted tree 106 is coupled to first lighted tree portion 104; and lighted tree-top portion 108 is coupled to second lighted tree portion 106.

More specifically, lower power-supply connector assembly 202 of first lighted tree portion 104 is inserted into an upper portion of cavity 140 of base-trunk portion 118, such that base portion 102 supports first lighted tree portion 104 in a generally vertical or upright position. The lower power-supply connector assembly 202 of second lighted tree portion 104 is likewise inserted into an upper portion of cavity 186 of upper portion 180 of first trunk portion 180 of first lighted tree portion 104, such that second lighted tree portion 106 is supported by first lighted tree portion 104 in a generally upright and vertical position. Lower portion 356 of lighted tree-top support connector 352 is inserted into an upper portion of cavity 318 of second trunk portion 310 of second lighted tree portion 106, thereby supporting lighted tree-top portion 108 also in a generally vertical and upright position. As such, each of base-trunk portion 118, first tree trunk portion 170, second tree trunk portion 310, and mast 350 align along a common vertical axis.

Further, when support connectors 202 are keyed, such that they include keyways 284, and base-trunk portion 118, first trunk portion 170, and second trunk portion 310 include complementary keys or projections (not shown), each tree portion must be aligned with its adjacent tree portion or base portion 102 in order to fit the portions together. As such, not only is each mechanical connection between lighted tree portions made, but the appropriate electrical connections between each lighted tree portion are also made. In other words, proper or correct mechanical alignment causes correct alignment of electrical connectors and their respective power transmission wires, as described further below, and with respect to FIG. 14.

In an alternative embodiment, connectors 200 and 202 may not be keyed, and do not include a pair of side-by-side terminals as depicted. In such an embodiment, electrical terminals, such as terminals 302, 304, and so on, are coaxially aligned. In such an embodiment, a rotational alignment between a first tree portion 104 and a second tree portion 106 may be made independent of a rotational alignment of the two tree portions. Such non-keyed connectors and connector systems are described in United States Patent Publication US2012/0076957, co-owned by the assignee of the present application, and herein incorporated by reference in its entirety.

Figure 14:
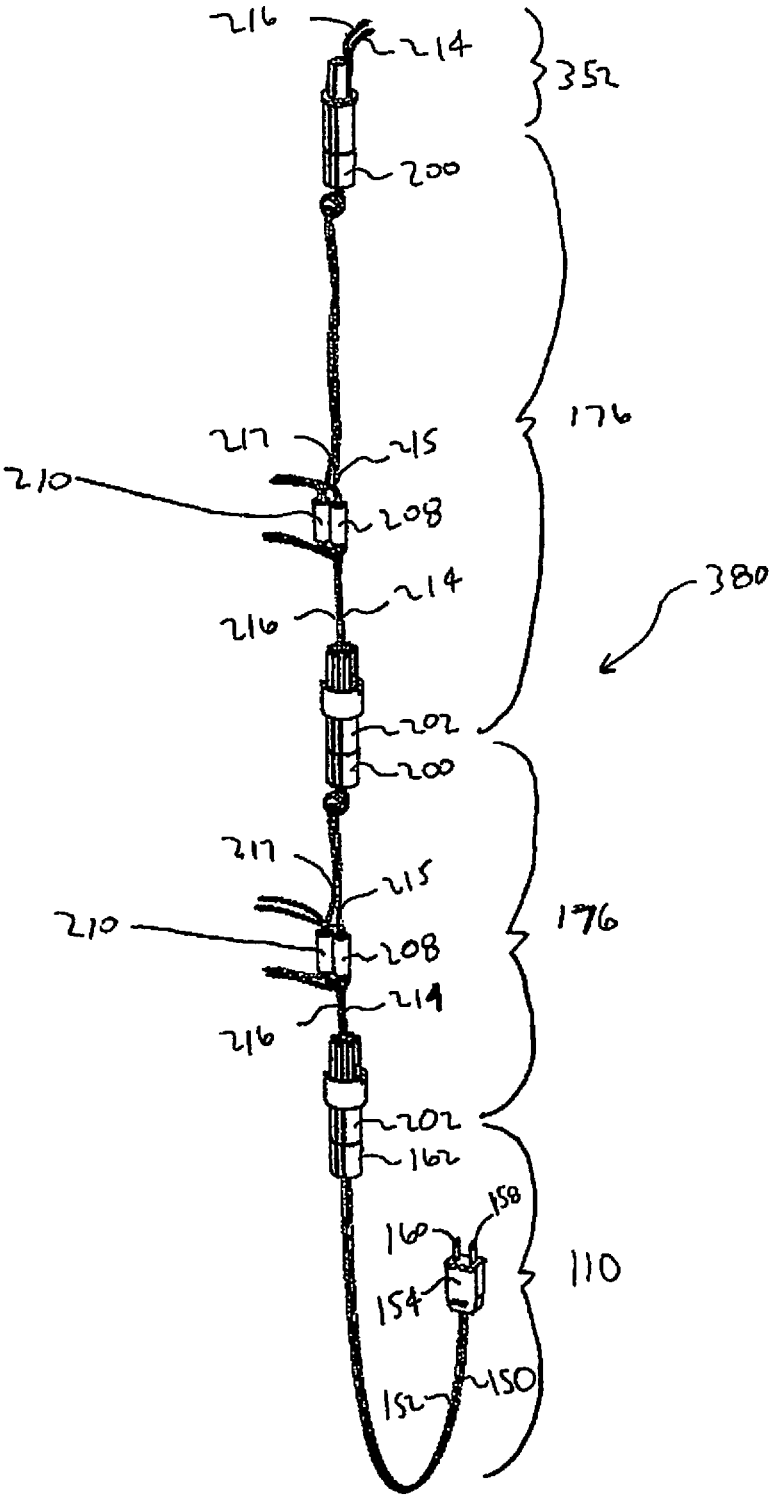
FIG. 14 is a front, perspective view of an assembled tree wiring harness of the tree of FIG. 1.
Figure 15:
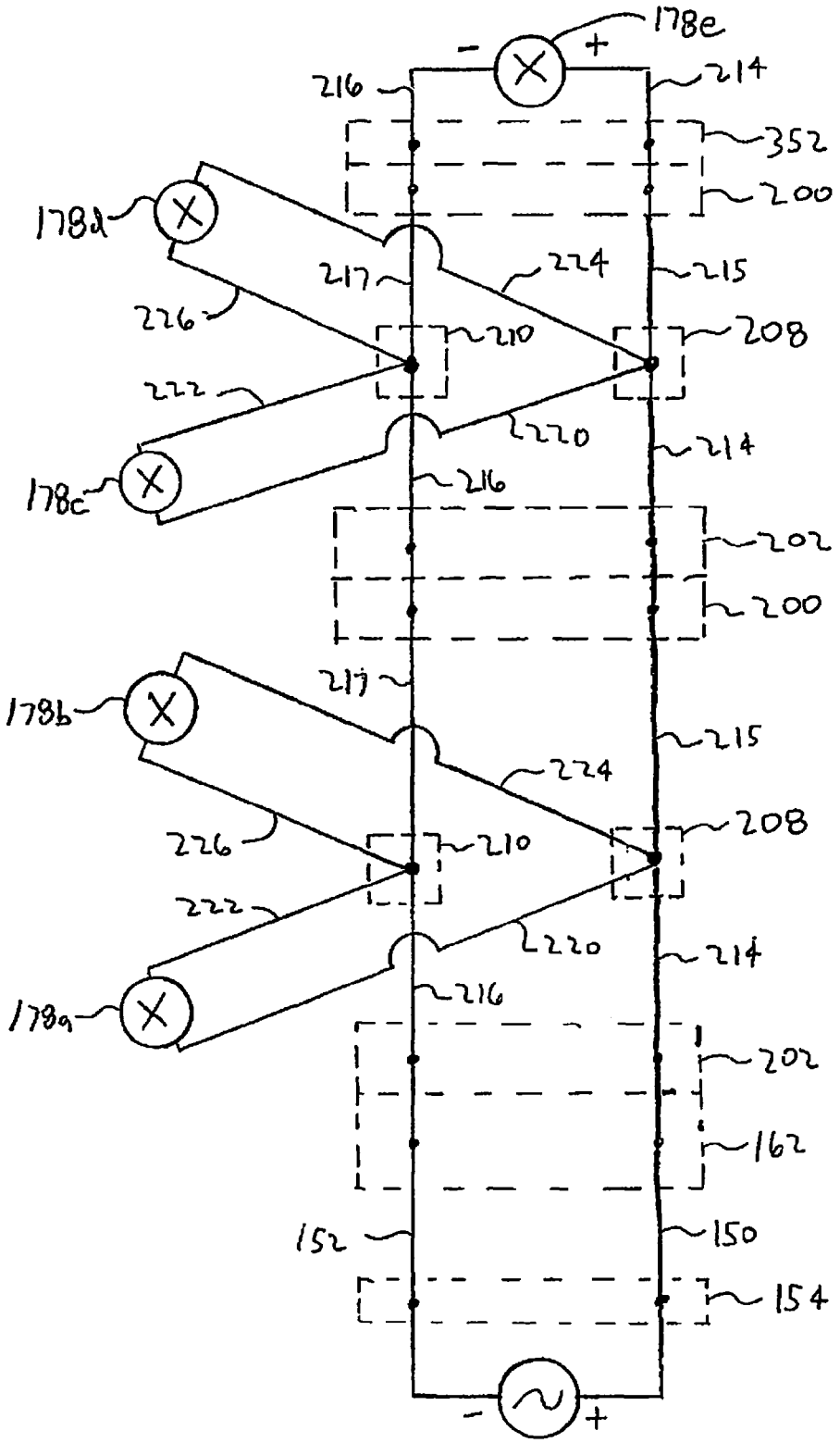
FIG. 15 is a block-circuit diagram of the lighted artificial tree of FIG. 1.

Referring to FIGS. 14 and 15, an assembled tree wiring harness 380 of lighted artificial tree 100, and its corresponding electrical schematic, are respectively depicted. Tree harness 380 comprises power cord assembly 110 of base tree portion 102, power-supply wiring harness 176 of first lighted tree portion 104, power-supply wiring harness 176 of second lighted tree portion 106, and tree-top support connector 352 of lighted tree-top portion 108.

When artificial lighted tree 100 is assembled, and when first lighted tree portion 104 is inserted into base portion 102, plug 162 of power cord assembly 110 is connected, or plugged into, lower power-supply connector assembly 202 of first lighted tree portion 104, thereby electrically connecting first contact 302 (see also FIG. 9) of lighted tree portion 104 to first base-trunk contact 166, thereby also electrically connecting first contact 302 to first power cord transmission wire 150, to first power wire contact 158 of plug assembly 154, and to a first pole of an external power source when tree 100 is powered. Second contact 304 of lighted tree portion 104 is then electrically connected to second base-trunk contact 168, thereby also electrically connecting second contact 304 to second power cord transmission wire 152, to second power wire contact 160 of plug assembly 154, and to a second pole of an external power source when tree 100 is powered.

Similarly, when second lighted tree portion 106 is coupled to first lighted tree portion 104, power-supply connector assembly 200 of first lighted tree portion 104 is connected to lower power-supply connector assembly 202 of second lighted tree portion 106. This coupling causes first contact 302 of second lighted tree portion 106 to be electrically connected to first contact 246 of first lighted tree portion, thereby also electrically connecting first contact 302 to first power transmission wires 215 and 214 and first contact 302 of first lighted tree portion 104. As described above, contact 302 of first tree portion 104 is in electrical contact with first power transmission wire 150 and first power wire contact 158. Second contact 304 of lighted tree portion 106 is then electrically connected to second contact 248 of first lighted tree portion 106, thereby also electrically connecting second contact 304 to transmission wires 217 and 216, second contact 304 of first lighted tree portion 104, second power cord transmission wire 152, second power wire contact 160 of plug assembly 154, and a second pole of an external power source when tree 100 is powered.

Connecting tree-top support connector 352 to power-supply connector assembly 200 of second lighted tree portion 106 causes first contact 302 (and wire 214) to be electrically connected to first contact 246 of second lighted tree portion 106, and second contact 304 (and return wire 216) to be electrically connected to second contact 248 of second lighted tree portion 106.

With these electrical connections, when lighted artificial tree 100 is connected to, and power by, an external power source, power is available throughout tree 100, with one pole of the power source electrically connected to power transmission wires 214 and another pole to return wires 216.

The electrical connections of the various components of lighted artificial tree 100 and tree wiring harness 380 may be further understood by referring to the electrical schematic and block diagram depicted in FIG. 15 in which the various couplers and connectors forming mechanical connections are shown in dashed line.

Figure 16:
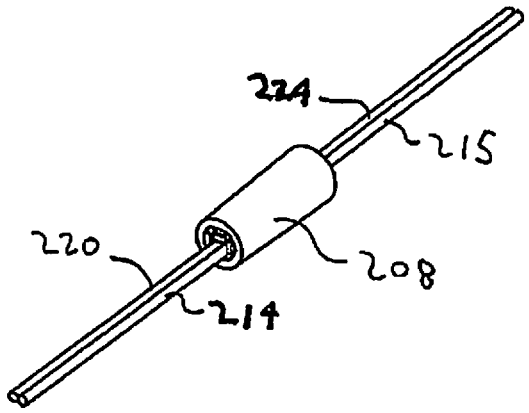
FIG. 16 is a front, perspective view of a two-wire-to-two-wire unipolar coupler assembly according to an embodiment of the present invention.

The unique wiring configurations and electrical connections of artificial lighted tree 100 rely on the use of multiple pairs of unipolar light-string couplers 208 and 210. As described above, and as depicted in FIG. 16, a single light-string coupler 208 receives the ends of a pair of wires, power transmission wire 214 and lead wire 220 at one end, and a pair of wires at another end, power transmission wire 215 and lead wire 224. As such, unipolar light string coupler 208 (and counterpart coupler 210) may be described as a two-into-two unipolar coupler, having an incoming power transmission wire, for example, power transmission wire 214, an outgoing power transmission wire, for example, power transmission wire 215, and a pair of outgoing lead wires for a pair of light strings 178.

However, unipolar light-string couplers of the present invention need not be limited to the two-into-two-style of coupler. In other embodiments, additional power transmission wires and additional lead or return wires may be coupled by the unipolar light-string couplers of the present invention. For a tree wiring harness 380 having first and second power transmission wires extending vertically along its trunk, unipolar couplers may generally only have one incoming, or first, power transmission wire, one outgoing, or second, power transmission wire, and multiple lead or return wires.

Figure 17:
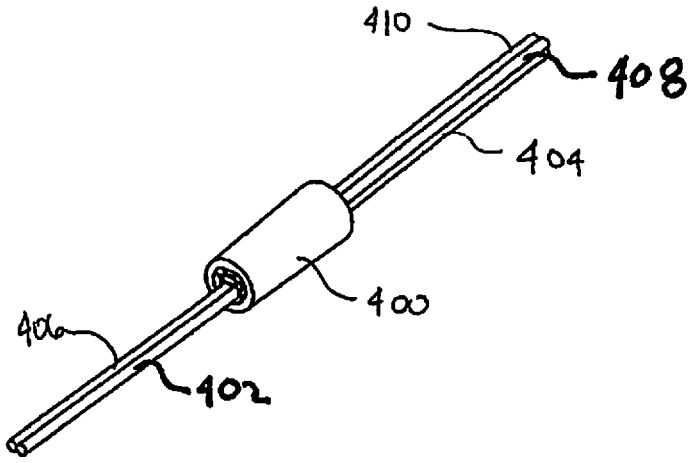
FIG. 17 is a front, perspective view of a two-wire-to-four-wire unipolar coupler assembly according to an embodiment of the present invention.

Referring to FIG. 17, in one such alternate embodiment, unipolar light-string coupler 400 comprises a two-into-four light string coupler. In this embodiment, unipolar light-string coupler 400 receives ends of incoming power transmission wire 402, outgoing power transmission wire 404 and ends of four light string lead wires, 406, 408, 410, and another not depicted, thus electrically and mechanically connecting all six wires.

Figure 18:
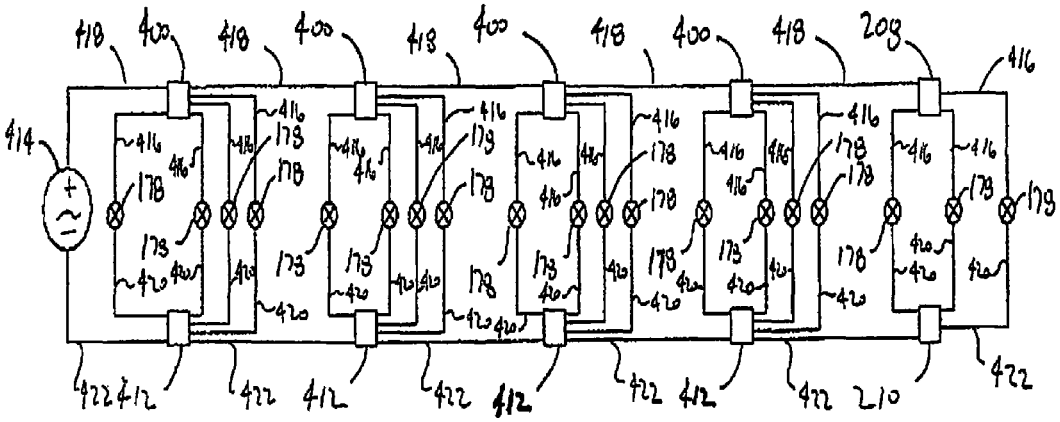
FIG. 18 is a circuit diagram for another embodiment of the tree of FIG. 1.
Figures 20A, 20B, 20C, 20D, 20E, 20F, 20G:
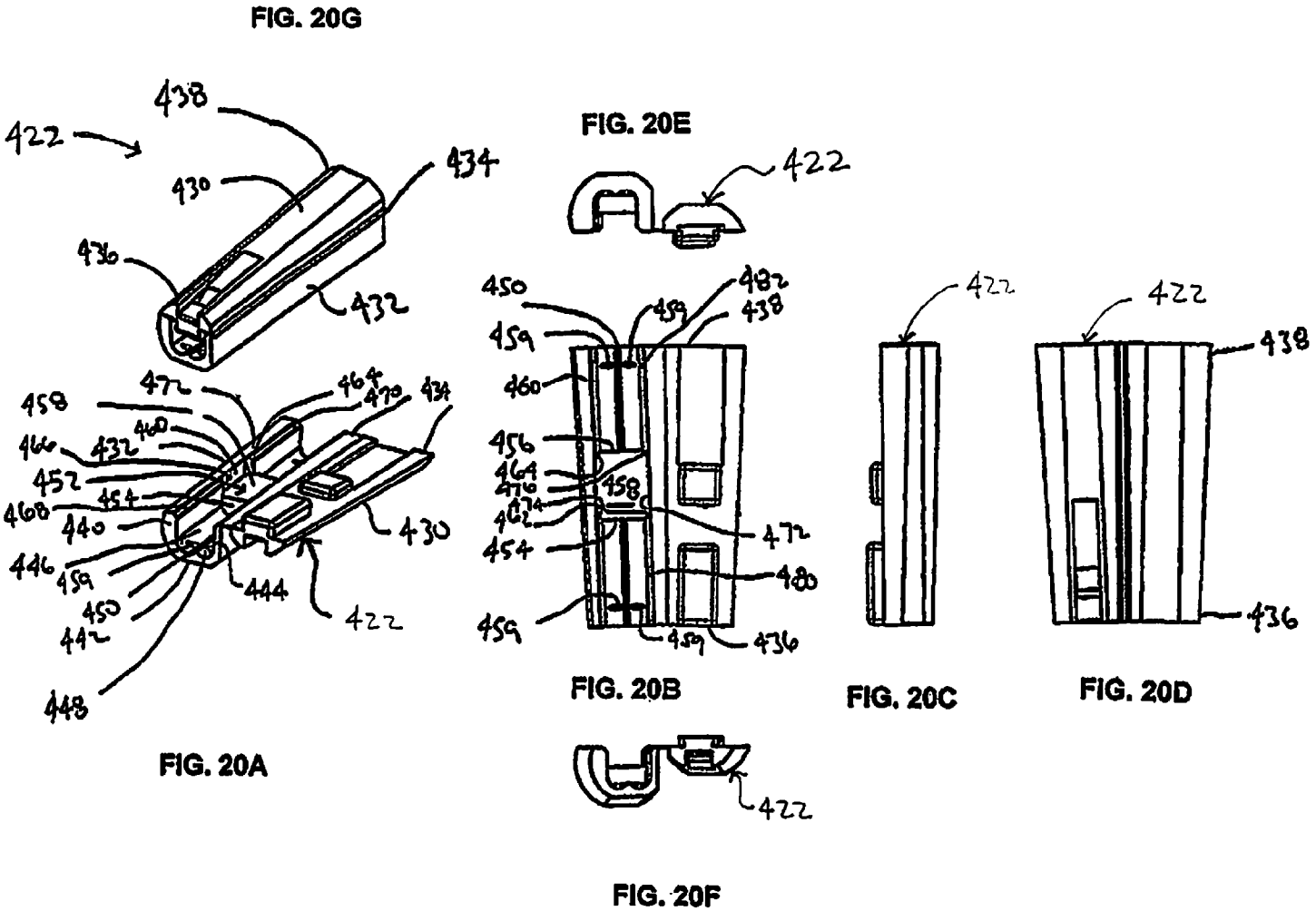
FIG. 20A is a front, perspective view of the insert of FIG. 19, in an open position.
FIG. 20B is a front elevation view of the insert of FIG. 20A.
FIG. 20C is a right-side elevation view of the insert of FIG. 20A.
FIG. 20D is a rear elevation view of the insert of FIG. 20A.
FIG. 20E is a plan view of the insert of FIG. 20A.
FIG. 20F is a bottom view of the insert of FIG. 20A.
FIG. 20G is a front, perspective view of the insert of FIG. 19, in a closed open position.
Figures 21A, 21B, 21C, 21D, 21E:
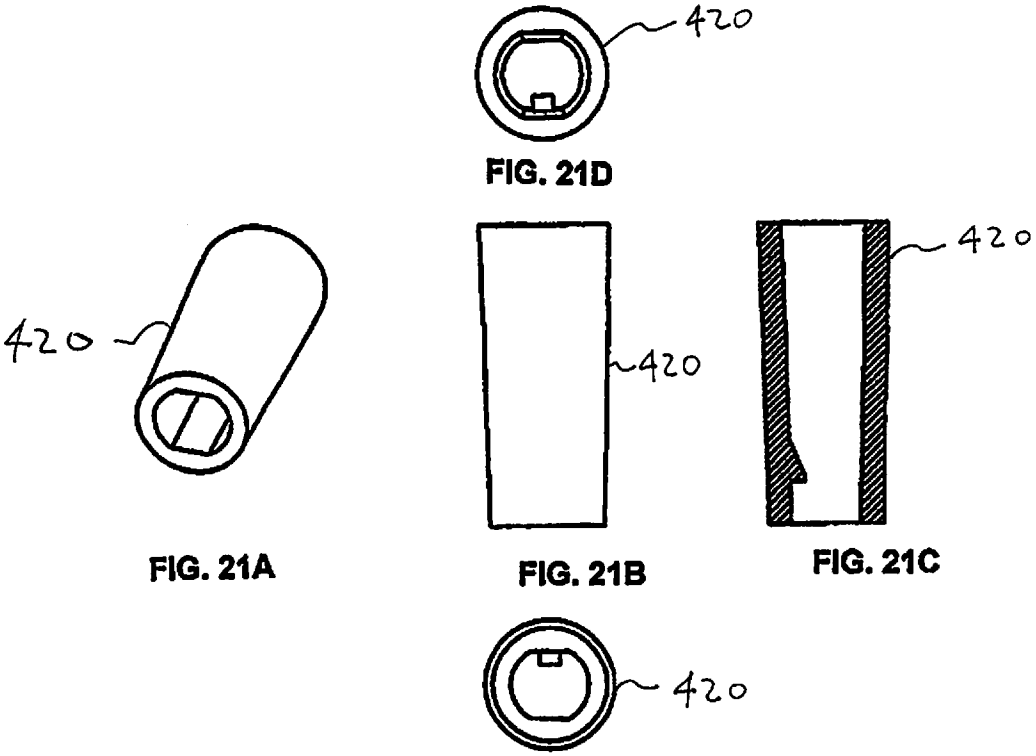
FIG. 21A is a front, perspective view of a sleeve of the two-wire-to-four-wire unipolar coupler assembly of FIGS. 17 and 18.
FIG. 21B is a front elevation view of the sleeve of FIG. 21A.
FIG. 21C is a cross-sectional view of the sleeve of FIG. 21A.
FIG. 21D is a plan view of the sleeve of FIG. 21A.
FIG. 21E is a bottom view of the sleeve of FIG. 21A.

Referring to FIG. 18, different types of unipolar light-string couplers may be used on a single lighted artificial tree 100. FIG. 18 depicts an electrical schematic for another embodiment of an artificial lighted tree 100 that includes four pairs of two-into-four light string couplers (four light-string couplers 400 and four light-string couplers 412), and a pair of two-into-two light string couplers, 208 with 210.

In this embodiment, external power source 414 provides power to 19 light strings 178. External power source 414 is depicted as an AC power source, though in other embodiments, external power source could be a DC power source. Each coupler 400 is connected to one side or pole of power source 414, while each coupler 412 is connected to the other side or pole of external power source 414. Each light string is connected at one end by a lead wire 416 to a coupler 400 and a pair of power transmission wires 418, and at another end by a return wire 420 to a coupler 412 and a pair of power transmission wires 422, such that a voltage of external power source 414 is distributed across each light string 178.

In one embodiment, external power source comprises a 120 VAC power source, each light string 178 includes 50 series-connected lighting elements, each with a rating of 2.5 VAC, 0.17 A, for a total of 950 lights; each power transmission wire 418 and 422 comprises a 20 AWG wire; and each lead wire 416 and return wire 420 comprise 22 AWG or thinner wires. Additional light strings 178 could be added by simply adding additional pairs of unipolar light-string couplers 400/412 or 208/210.

412 or 208/210.

Referring to FIGS. 19 to 21E, an exemplary two-into-four light string coupler 400 is depicted. While these figures and accompanying description are directed to a two-into-four coupler 400, it will be understood that a two-into-four coupler 208, or 210 is substantially the same, with only slight variations as detailed below. Further, it will be understood that while FIGS. 19 to 21*e* refer to and depict coupler 400, the other coupler 410 forming the pair of couplers, is structurally the same as coupler 400, each being connected to opposite poles of a circuit.

Figure 19:
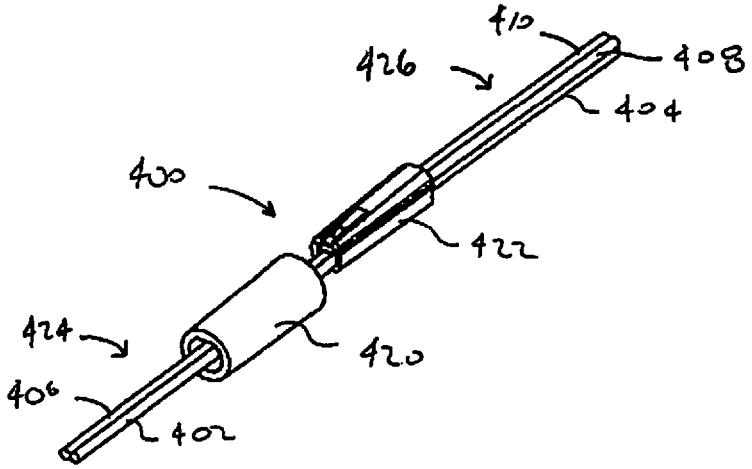
FIG. 19 is a front, perspective view of the two-wire-to-four-wire unipolar coupler assembly of FIG. 17, with the sleeve partially removed.

Referring specifically to FIG. 19, two-into-four light-string coupler 400 includes tapered sleeve 420 and insert 422. Insert 422 clamps onto wire bundle 424 and wire bundle 426, while tapered sleeve 420 slides over wire bundle 424 and over insert 422. Tapered sleeve 420 and 422 may comprise any of a variety of generally insulative materials, include various types of plastics and polymers, including polypropylene (PP), polyethylene (PE), and others.

Referring to FIGS. 20A to 21E, details of an embodiment of insert 422 are depicted. FIG. 20G depicts insert 422 in closed position, while FIGS. 20A to 20F depict various views of insert 422 in an open position.

Insert 422 includes lid portion 430 joined to channel portion 432 at living hinge 434, as well as narrow end 436 and wide end 438.

Channel portion 432 includes opposing wall 440, bottom wall 442 and hinge wall 444, each of which extends along a length of channel portion 432. Bottom wall 442 defines first wire channel 446 and second wire channel 448, and presents central ridge 450 separating channels 446 and 448. Wire channels 446 and 448 are sized to receive an end portion of an insulated wire, such as power transmission wire 402 and lead wire 406.

Bottom wall 442 also presents tab plateau 452 which bifurcates each of wire channels 446 and 448 into a narrow end and a wide end, of each channel. Tab plateau 452 includes narrow-end side wall 454, wide-end side wall 456, and presents tab-engaging surface 458.

Bottom wall 442 also may also include insulation-gripping projections 459. As depicted, each wire channel 446 and 448 includes a pair of insulation-gripping projections 459, one at narrow end 436, and another at wide-end 458.

Opposing wall 440 includes central wall portion 460, narrow-end angled wall portion 462 and wide-end angled wall portion 464, defining opposing-tab recess 466. Opposing wall 440 also includes narrow-end beveled wall portion 468 and wide-end beveled wall portion 470, extending along opposing wall 440 on either side of opposing tab recess 466. Opposing wall 440 further presents lid-engaging surface 472 which extends the length of opposing wall 440.

Hinge wall 444 includes central wall portion 472, narrow-end angled wall portion 474 and wide-end angled wall portion 476, defining opposing-tab recess 478. Hinge wall 444 also includes narrow-end beveled wall portion 480 and wide-end beveled wall portion 482, extending along hinge wall 444 on either side of opposing tab recess 478.

Figure 22:
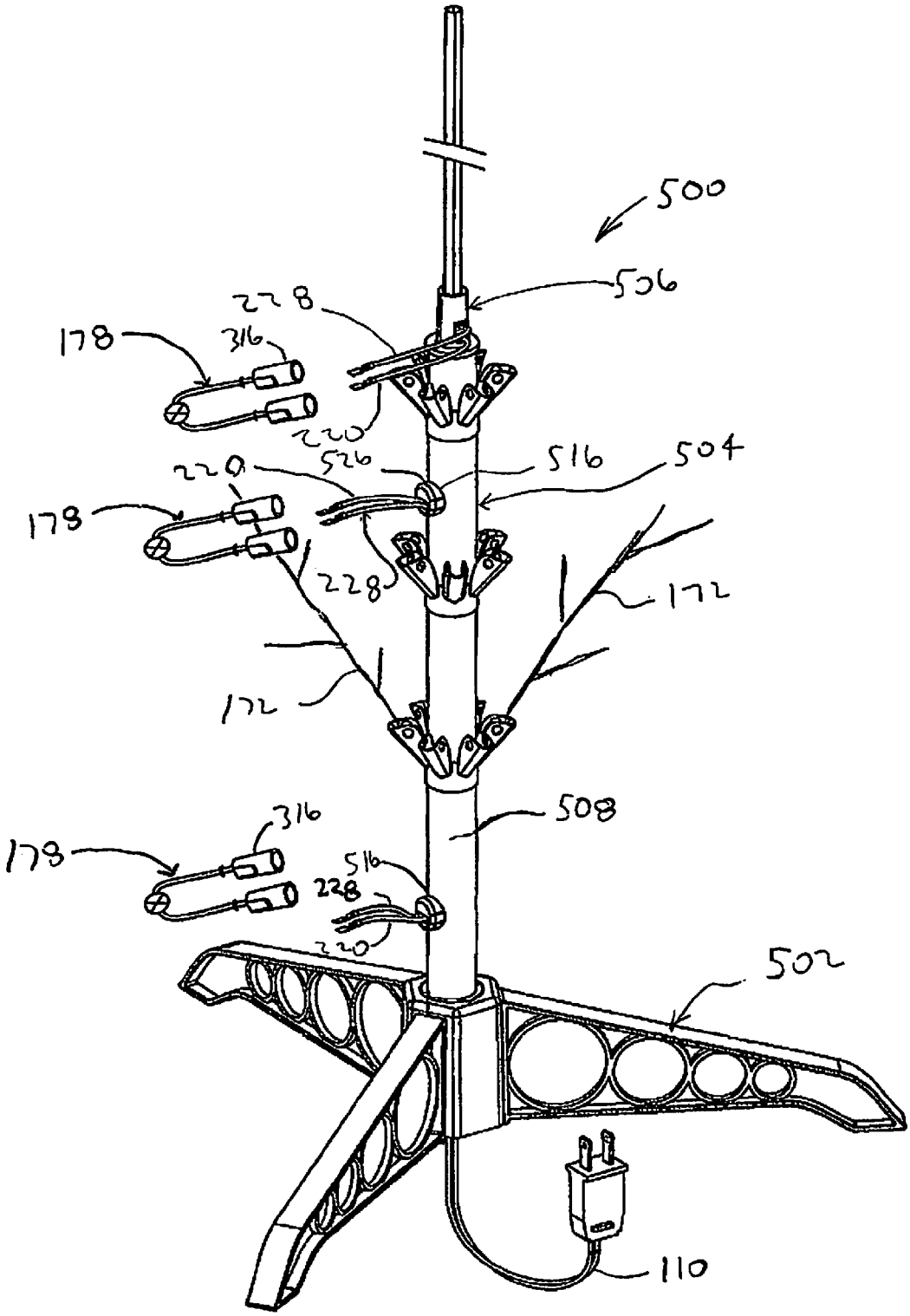
FIG. 22 is a front perspective view of another embodiment of a modular, lighted artificial tree of the claimed invention.

Referring to FIG. 22, an embodiment of modular, lighted artificial tree 500 is depicted. Tree 500 is substantially similar to tree 100 described above with respect to FIGS. 1-21. However, unlike tree 100, tree 500 includes an internal power supply wiring harness assembly that is located wholly or substantially within the trunk of the tree.

As depicted, lighted artificial tree 500 includes power cord assembly 110, base portion 502, first tree portion 504, and tree-top section 506. Although second and third tree portions are not depicted, it will be understood that in other embodiments, additional tree portions, similar to those described with respect to tree 100 may be included.

Figure 23:
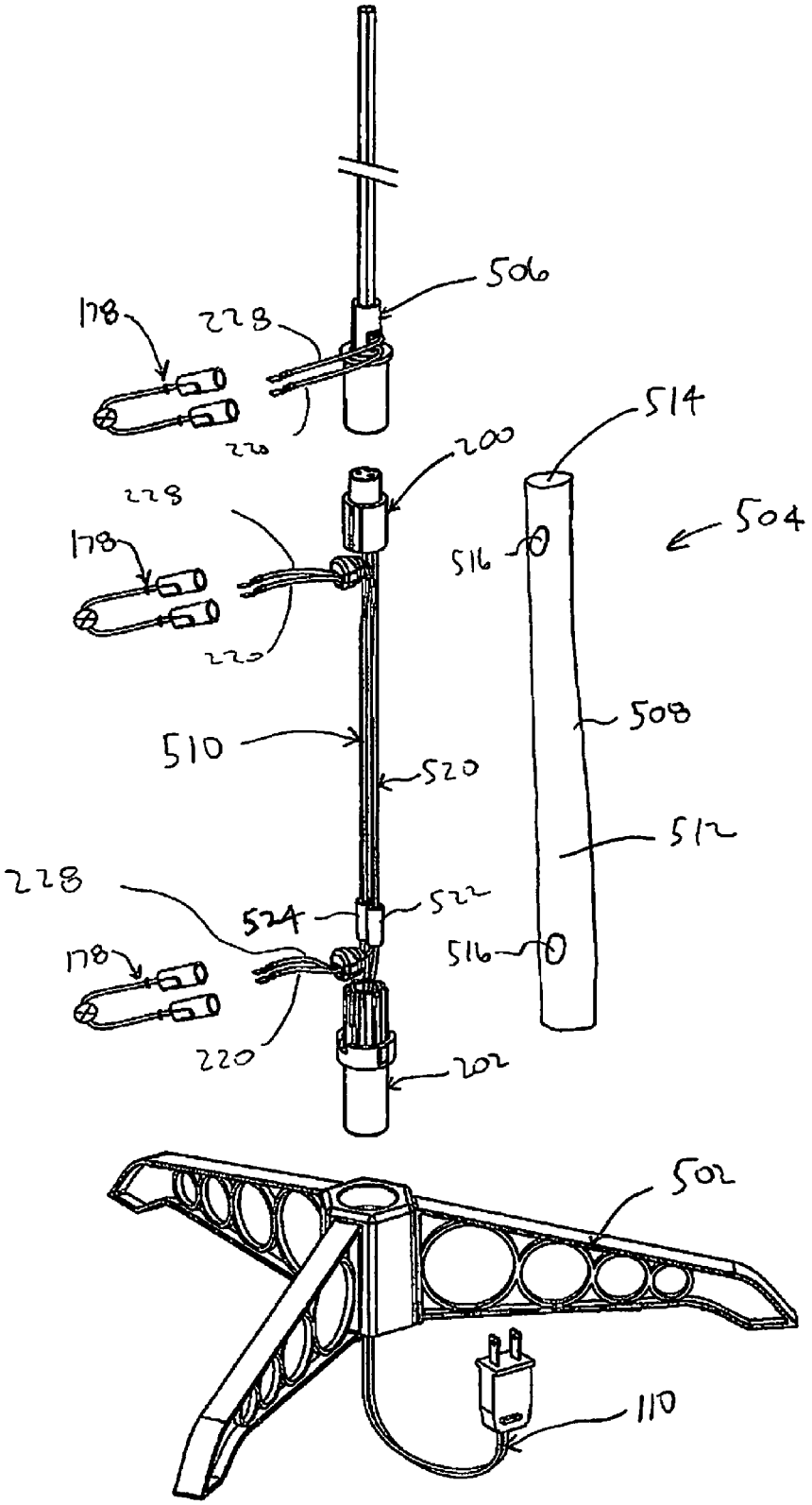
FIG. 23 is an exploded view of the tree of FIG. 22, according to an embodiment of the claimed invention.

Referring to FIG. 23, an exploded view of lighted artificial tree 500 is depicted. First tree portion 504 includes trunk portion 508, power-supply wiring harness assembly 510, and multiple light strings 178. It will be understood that light strings 178 are depicted simplistically and symbolically in FIGS. 22 and 23 to reduce complexity and increase understanding of the figures and the invention. Light strings 178 are generally attached to branches 172 in the same manner as light strings 178 of tree 100 are attached, and as depicted in FIG. 1.

Trunk portion 508, similar to the trunk sections described above with respect to tree 100, is generally cylindrical, having a trunk wall 512 defining trunk cavity 514 and multiple apertures 516. When assembled, power-supply wiring harness assembly 510 is located substantially, or wholly within trunk cavity 514.

Power-supply wiring harness 510 includes power-supply electrical connector 200, power-supply electrical connector assembly 202, wiring 520, and multiple wire couplers 522.

In an embodiment, electrical wire couplers 522 and 524 may comprise couplers substantially the same as unipolar couplers 208 and 210 as depicted and described above. As depicted, electrical wire couplers 522 and 524 each electrically connect or couple four wires together, two on each end. In other embodiments, wire couplers 522 and 524 may couple more or fewer wires. Although only two light strings 178 and two wire couplers, 522 and 524 are depicted, it will be understood that more or fewer light strings 178 and wire couplers 522 and 524 may be included. Further, wire couplers 522 and 524, in an embodiment are substantially the same.

When assembled, portions of light strings 178 pass through apertures 516 and are connected to power-supply wiring harness 510 by wire couplers 522 and 524. Wires of each light string 178 pass through a common aperture 516.

Figure 24A:
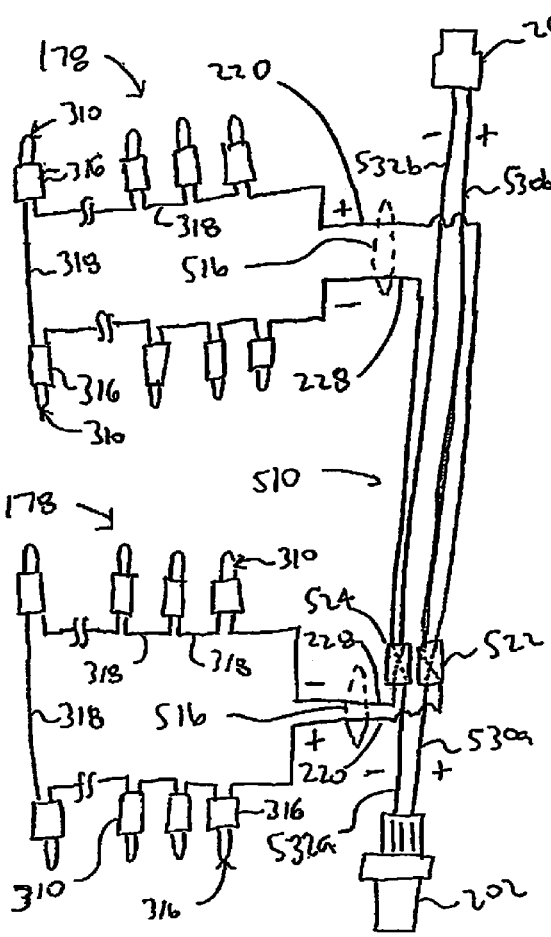
FIG. 24A depicts a wiring layout and connection of a power supply wiring harness and light strings of the tree of FIG. 22, according to an embodiment of the claimed invention.
Figure 24B:
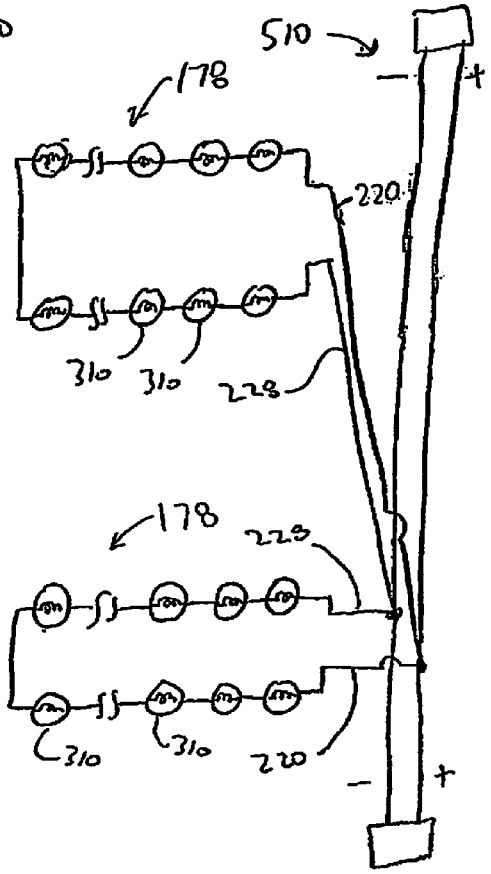
FIG. 24B is an electrical schematic of the wiring layout and connection of FIG. 24A.

Referring to FIGS. 24A and 24B, block diagram of the wiring of power-supply wiring harness 510 connected to a pair of light strings 178, and an electrical schematic of same, is depicted respectively.

Referring specifically to FIG. 24A, wiring 520 of power-supply wiring harness 510 includes first power transmission wires 530*a* and 530*b*, and second power transmission wires 532*a* and 532*b*. Power transmission wires 530 and 532 transmit power from connector 202 at one end of first tree portion 504 to connector 200 at the other end of first tree portion 504, and provide power to light strings 178.

As described above with respect to tree 100, light strings 178 include a plurality of lighting element assemblies 310 and light string wire set 312, and may be configured electrically in series, parallel, series-parallel, or parallel series. Light strings 178 are attached to branches 172 (see FIG. 1), with lighting element assemblies 310 distributed about the branches. Portions of light string wire set 312 are clipped, or otherwise attached, to portions of branches 172, as depicted and described above with respect to FIG. 1.

Wire set 312 includes individual wires or wire segments 318 connected to individual lighting element assemblies 310, as well as lead wire 220 and a return wire 228. It will be understood that "lead" wire and "return" wire refer to the two wires supplying power to light strings 178, such that the term "lead" is also known in the art as a "supply" wire, "hot" or "fire" wire, or generally a first polarity wire, while "return" is also known in the art as a "ground" wire, "negative" wire, or generally a second polarity wire. Lead wire 220 and return wire 228 each pass through a common aperture 516 of trunk portion 508, into trunk cavity 514, and are electrically connected to power-supply wiring harness 510 at points within trunk cavity 514, thusly supplying power to light string 178.

In an embodiment, lead wire 220 is electrically connected and physically coupled to first power transmission wires 530*a* and 530*b* of power-supply wiring harness assembly 510; return wire 228 is electrically connected and physically coupled to second power transmission wires 532*a* and 532*b*. In an embodiment, and as depicted the electrical connections are made by unipolar light string couplers 522 and 524, respectively. In other embodiments, lead wires 220 and 228 may be connected to power-supply wiring harness 510 using other known connectors and connection means.

Though not required, plugs 526 may be inserted into trunk apertures 516, and lead wire 220 and return wire 228 may pass through plug 526 as well as apertures 516. Plug 526 serves to prevent an insulation of the wires from contacting trunk 508, thereby preventing damage to the insulation, and minimizing any possibility of electrical connection between the wires and the trunk.

As depicted in FIG. 24A, light strings 178 may comprise a single-wire loop (also known as single loop) construction. Light strings 178 may also comprise a single electrical circuit, such as a single set of series-connected light element assemblies 310 or a single set of parallel connected light element assemblies, such that every housing 316 comprises a two-wire housing, rather than including three-wire, or even four-wire, housings 310. As described above, such a configuration provides significant manufacturing advantages.

Referring also to FIG. 24B, an embodiment wherein first tree portion 504 includes light strings 178 each comprise a single set of lighting element assemblies 310 electrically-connected in series is depicted. As depicted in both FIGS. 24A and 24B, each lead wire 220 is attached at a first common point at power-supply wiring harness 510, and each return wire 228 is attached at a second common point of power-supply wiring harness 510. Such is the case when a single coupler 522 or 524 is used to connect more than one lead or return wire to harness 510 at a single point. In other embodiments, lead wires 220 of multiple sets of light strings 128 may not be connected at a common point, and return wires 228 may not be connected at another common point.

In an embodiment, and as depicted, a lead wire 220 and its corresponding return wire 228 enter trunk portion 508 through a common aperture 516. In a further such embodiment, any one aperture 516 has only a portion of a single light string 178 passing through it. Such a configuration serves to minimize the amount of wire outside trunk portion 508, as well as improving wire organization and distribution, thereby providing an improved visual appearance and improved manufacturing ease.

Figure 25:
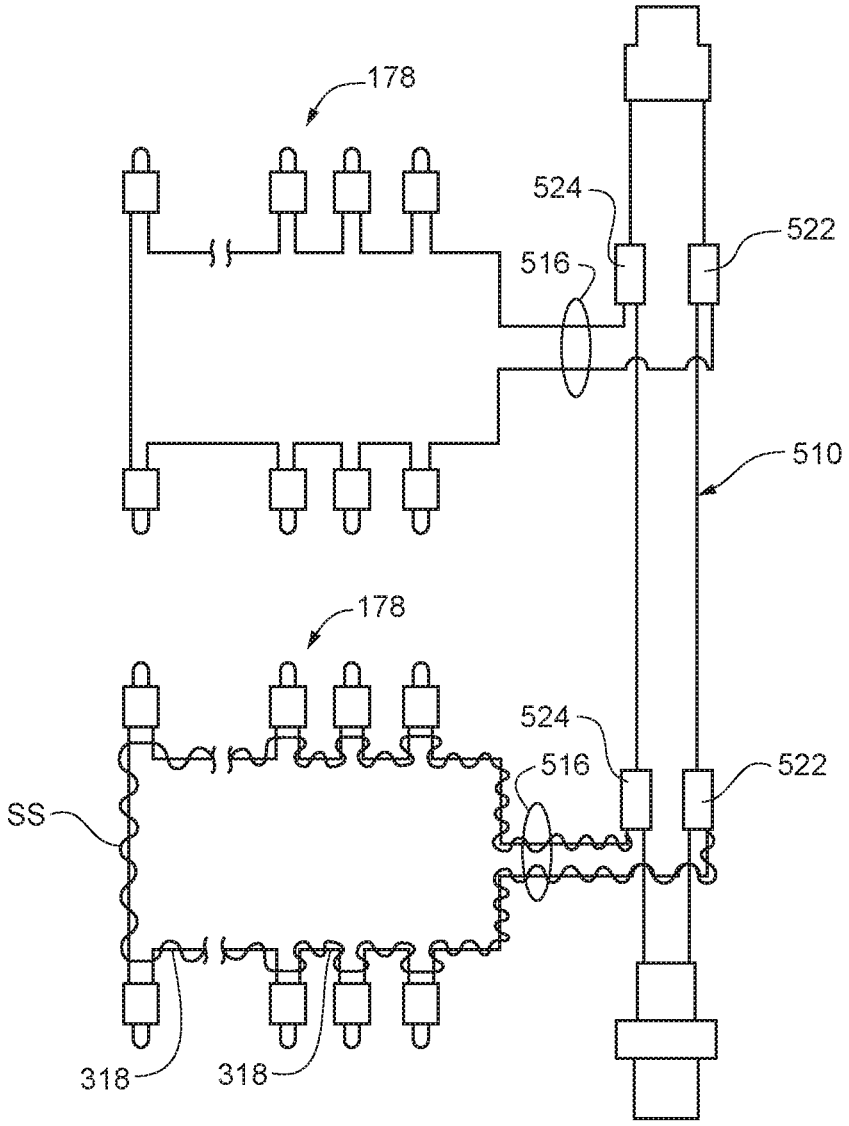
FIG. 25 depicts an alternative wiring layout and connection of a power supply wiring harness and light strings of the tree of FIG. 22, according to an embodiment of the claimed invention.

Referring to FIG. 25, an embodiment of power-supply wiring harness 510 coupled to two light strings 178 is depicted. In this alternate embodiment, each light string 178 is connected to wiring harness 510 by a pair of couplers 522 and 524. Further, each light string 178 is connected to wiring harness 510 at a unique point along the length of wiring harness 510, as compared to being connected at a common point, as depicted in FIG. 24A.

Embodiments of the claimed invention include not only systems and devices, but also methods. In an embodiment, the claimed invention includes method of manufacturing a modular, lighted artificial tree.

In an embodiment, a method of the claimed invention includes inserting all or a portion of power-supply wiring harness 510 inside trunk cavity 514 of trunk 508 of first tree portion 504; securing a first power supply electrical connection assembly 202 at a first end of the trunk and a second power supply electrical connection assembly 200 at a second end of the trunk; inserting lead wire 220 of light string 178 through an aperture 516 in a side wall 512 of trunk 508; inserting a return wire 228 of the light string through the aperture 516 in the side wall of the trunk; electrically connecting the lead wire to a first power transmission wire of the power-supply wiring harness 510; and electrically connecting the return wire 228 to a second power transmission wire of the power supply wiring harness. In an embodiment, the electrical connections are made within trunk cavity 512.

Referring to FIGS. 26-32, another embodiment of a modular, lighted artificial tree, tree 600, is depicted. Tree 600 shares many of the features of trees 100 and 500 described above, though embodiments of modular, lighted artificial tree 600 may include a multi-pin power-supply wiring harness for multi-function control of light strings and/or for distributed electrical power supply, as well as power-supply wiring connectors wholly inside the trunk, and locking light-string trunk connectors.

Figure 26:
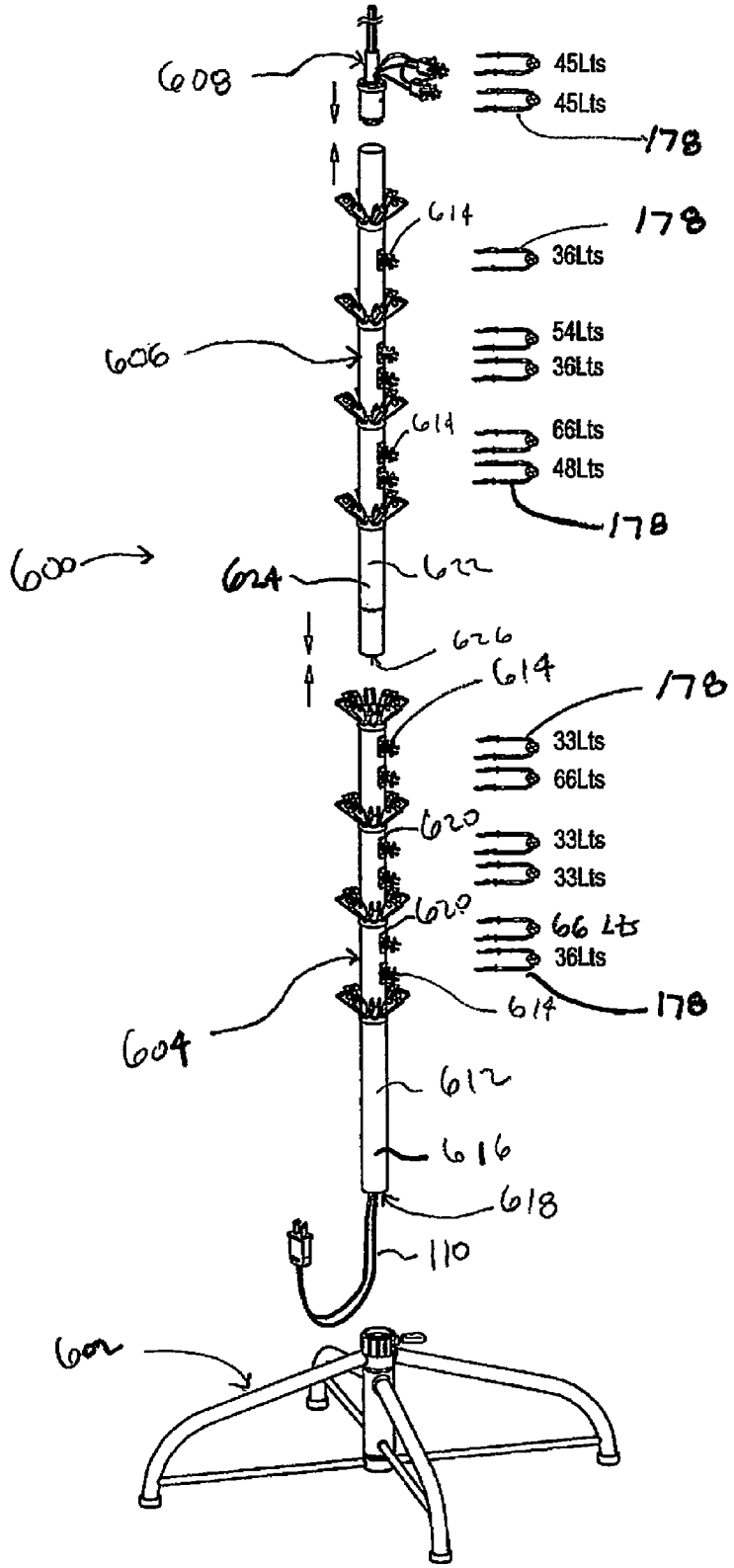
FIG. 26 is a front, perspective view of a modular, lighted artificial tree having a multi-terminal power supply wiring harness, according to an embodiment of the claimed invention.
Figure 27:
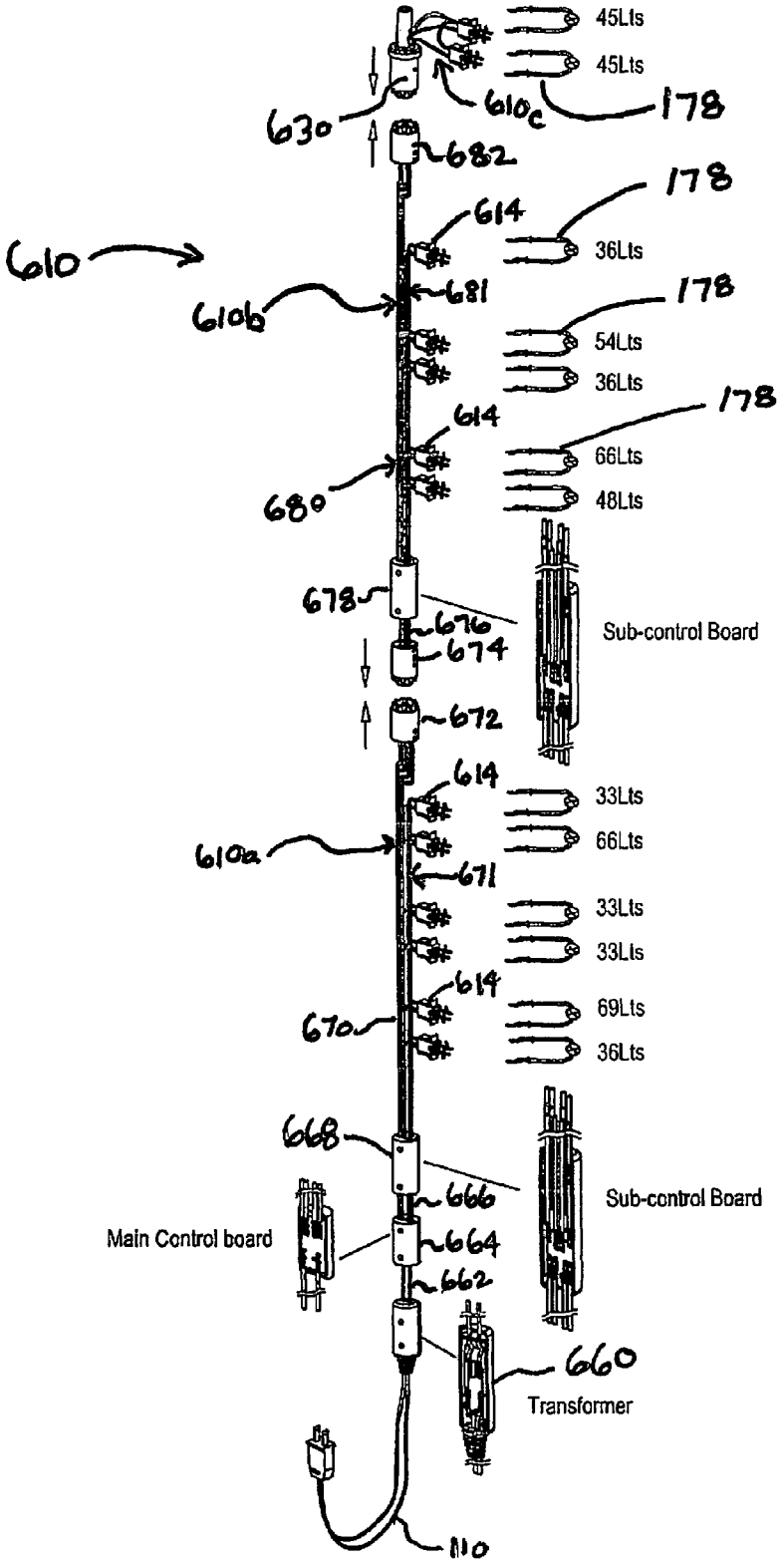
FIG. 27 is a partially exploded view of a power supply wiring harness of the tree of FIG. 26.

Referring specifically to FIGS. 26-28, modular, lighted artificial tree 600 includes power cord assembly 110, base portion 602, first tree portion 604, second tree portion 606, tree top portion 608, and power-supply wiring harness 610. Although not depicted in FIG. 26, each tree portion 604, 606 and 608 may also include branches 172. Further, light strings 178 are depicted symbolically in FIG. 26 for simplicity, though it will be understood that light strings 178 are connected or coupled to tree 600, and include construction and features as described above with respect to trees 100 and 500.

In an embodiment, first tree portion 604 includes trunk portion 612, branches 172 (see FIG. 1), a plurality of light strings 178, power-supply wiring harness portion 610*a* and a plurality of trunk-light connectors 614. It will be understood that although light strings 178 are depicted as having a particular number of lighting element assemblies 310, for example, 36, 45, 48, 54, or 66 lights, each light string 178 may have more or fewer lighting element assemblies 310, and tree 600 and tree portion 604 may have more or fewer light strings 178. Trunk portion 612 includes trunk wall 616, and defines internal trunk cavity 618 and multiple trunk apertures 620.

Branches 172 are coupled to trunk portion 612; power-supply wiring harness portion 610*a* is located wholly or substantially within trunk cavity 618; trunk-string connectors 614 are coupled to trunk wall 616, such that a portion of each trunk-string connector 614 extends into trunk cavity 618; and light strings 178 are connected to trunk-string connectors 614.

Similar to first tree portion 604, second tree portion 606 includes trunk portion 622, branches 172 (see FIG. 1), a plurality of light strings 178, power-supply wiring harness portion 610*b* and a plurality of trunk-light connectors 614. It will be understood that although light strings 178 are depicted as having a particular number of lighting element assemblies 310, for example, 36, 45, 48, 54, or 66 lights, each light string 178 may have more or fewer lighting element assemblies 310, and tree 600 and tree portion 604 may have more or fewer light strings 178. Trunk portion 622 includes trunk wall 624, and defines internal trunk cavity 626 and multiple trunk apertures 620.

Branches 172 are coupled to second trunk portion 622; power-supply wiring harness portion 610*b* is located wholly or substantially within trunk cavity 626; trunk-string connectors 614 are coupled to trunk wall 624, such that a portion of each trunk-string connector 614 extends into trunk cavity 618; and light strings 178 are connected to trunk-string connectors 614.

Figures 28A, 28B:
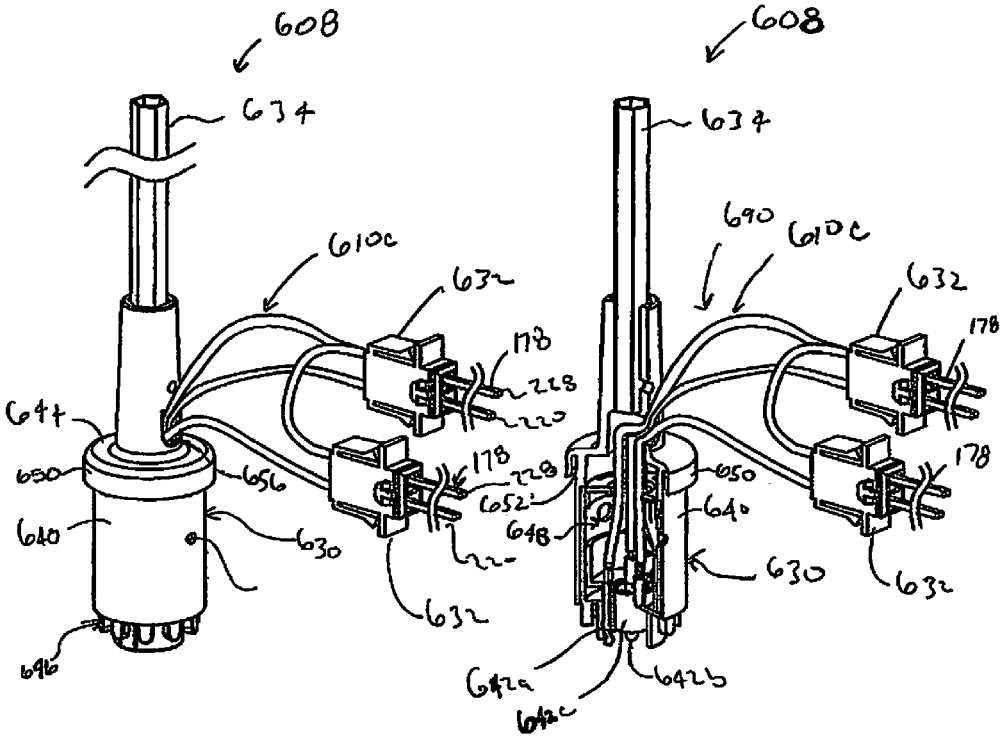
FIG. 28A is a front perspective view of a tree top portion of the tree of FIG. 26.
FIG. 28B is a view of the tree top portion of FIG. 28A in partial cross-section.

Referring specifically to FIGS. 28*a* and 28*b*, tree top portion 608 includes trunk power-supply connector assembly 630, power-supply wiring harness portion 610*c*, light-string connectors 632, mast 634, and branches 172 (not shown in FIGS. 28*a* and 28*b*).

In an embodiment, branches 172 are connected to mast 634; mast 634 is coupled to connector assembly 630; and wiring harness portion 610*c* is coupled to connector assembly 630; light-string connectors 632 are connected to wiring harness portion 610*c*; and a portion of light strings 178, lead wires 220 and return wires 228, are electrically connected to wiring harness portion 610*c* via connectors 632.

Trunk power-supply connector assembly 630 includes housing 640, and a plurality of electrical pins or terminals 642, including terminals 642*a*, 642*b*, and 642*c*. In other embodiments, trunk power supply connector assembly 630 includes more or fewer electrical pins or terminals 642.

Housing 640 in an embodiment includes top portion 644, bottom portion 646, and defines interior cavity 648. Top portion 644 includes flange 650 defining annular slot 652, and mast receiver 654. Mast receiver 654 extends upward and away from flange 650 and is adapted to receive and support mast 634.

Power-supply wiring harness portion 610*c* is coupled to housing 640, with a portion of wiring harness portion 610*c* being within cavity 648, and a portion outside cavity 648, such that a portion passes through aperture 656 of housing 640. Electrical terminals 642 are connected to the wires of wiring harness portion 610*c*.

When modular, lighted artificial tree 600 is assembled, first tree portion 604 is coupled to base portion 602, which in an embodiment has a bottom of trunk portion 612 fitting into a receiving portion of base 602. Second tree portion 606 couples to first tree portion 604. In an embodiment, a lower portion of trunk 622 has an outside diameter the same as, or slightly smaller than, an inside diameter of a top portion of trunk portion 612, such that the bottom portion of trunk 622 fits into a top portion of trunk portion 612. Similar to trees 100 and 500, and as described above, upon a mechanical connection of first and second tree portions 604 and 606, an electrical connection between tree portions is also made. In an embodiment, upon the mechanical connection of the first and second tree portions, the electrical connection is made independent of a rotational alignment or orientation of the two tree sections. In one such embodiment, one of the electrical terminals is centered about a vertical axis of its corresponding tree portion.

Tree top portion 608 is coupled to a top of second tree portion 606. In an embodiment, bottom portion 646 of housing 640 is inserted into trunk cavity 626 at a top end of trunk portion 622, such that trunk wall 624 fits into slot 652 of housing 640.

Referring to FIG. 27 specifically, details of tree power supply wiring harness 610 and its various components is depicted. Tree power-supply wiring harness 610 includes power cord assembly 110, first power-supply wiring harness 610*a*, second power-supply wiring harness 610*b*, and third, or tree-top wiring harness 610*c*. Each power-supply wiring harness electrically connects to its corresponding light sets 178 via light string connectors 614 and 632.

In an embodiment, first power-supply wiring harness 610*a* includes optional transformer 660, power transmission wires 662, main control/distribution hub 664, power transmission wires 666, sub-control/distribution hub 668, power transmission wires 670, light string power wires 671, and power-supply electrical connector assembly 672. First power-supply wiring harness 610*a* is housed in trunk cavity 618 of trunk portion 612. Further details of first power-supply wiring harness 610*a* will be depicted and discussed below with reference to FIG. 29.

Still referring to FIG. 27, second power-supply wiring harness 610*b* includes power-supply electrical connector assembly 674, power transmission wires 676, sub-control/distribution hub 678, power transmission wires 680, light power wires 681, and power-supply electrical connector assembly 682. Second power-supply wiring harness portion 610*b* is housed within trunk cavity 626 of trunk portion 622.

When connected together, power is transmitted through power cord assembly 110, through transformer 660 (when present) and throughout wiring harness portions 610*a*, 610*b*, and 610*c*, supplying lights to all tree portions and light sets 178.

Figure 29:
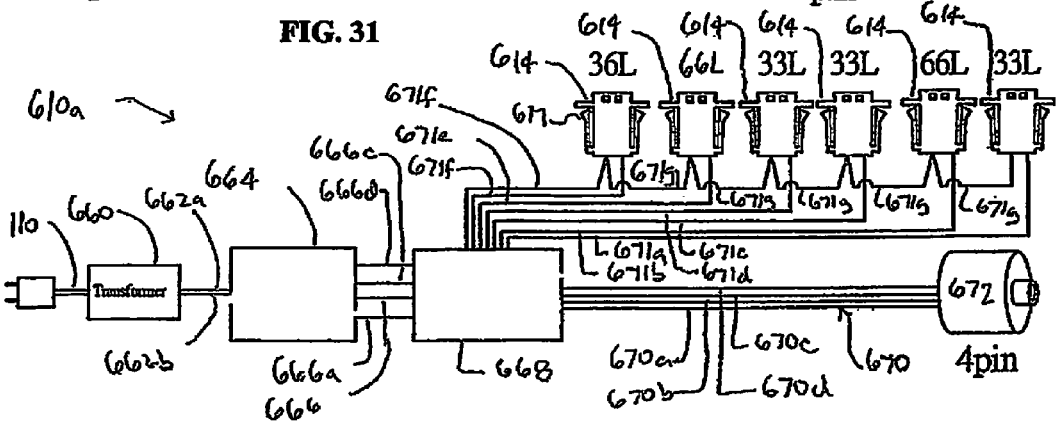
FIG. 29 is a wiring diagram of a power-supply wiring harness portion of a first tree portion of the power supply wiring harness of FIG. 27.

Referring specifically to FIG. 29, power-supply wiring harness portion 610*a* is depicted in greater detail. Power cord assembly 110 transmits power via two wires to transformer 660. In an embodiment, transformer or adapter 660 transforms an incoming source power to a power suitable for operating light strings 178. When transformer 660 is not used, supply power from an external source powers light strings 178 without conditioning, such as may be the case of with a 120 VAC power source. In embodiments of tree 600 including a transformer 660, the transformer may reduce and condition power, such as transforming an incoming relatively-high voltage alternating-current (AC) power to a relatively low-voltage direct current (DC) power. In an embodiment, a source provides a 110-120 VAC power to transformer 660, which outputs a 9 VDC power. It will be understood that nearly any combination of incoming and outgoing power may be used.

In an embodiment, transformer 660 is cylindrical in shape, and is configured to fit within trunk cavity 618 of trunk portion 612, or alternatively, to fit within base 602.

Conditioned supply power is transmitted through power transmission wires 662, which in an embodiment, includes power transmission wire 662*a*, having a first polarity, such as a positive polarity, and a second power transmission wire 662*b* having a second electrical polarity, such as a negative or neutral polarity.

Main control/distribution hub 664 receives supply power as transmitted from power transmission wires 662. In an embodiment, main control/distribution hub 664 simply serves as an electrical connection point, connecting incoming power transmission wires 662 to outgoing power transmission wires 666. In an embodiment, the number of outgoing power transmission wires 666 is greater than the number of incoming power transmission wires 662, for example, two wires in, four wires out. In one such embodiment, as depicted, power transmission wire 662*a* is electrically connected to power transmission wires 666*a* and 666*b*, while power transmission wire 662*b* is electrically connected to power transmission wires 666*c* and 666*d*. In such an embodiment, the conductors of power transmission wires 666 may be smaller in diameter than the conductors of power transmission wires 662. In an alternate embodiment, wire 662*a* is electrically connected to only one power transmission wire 666, such as wire 666*a*, while wire 662*b* is connected to three wires, 666*b*, 666*c*, and 666*d*.

Main control/distribution hub 664 may also include fuses (not depicted) between incoming and outgoing power transmission wires. In known decorative lighting systems, fuses are generally located within a housing of the power cord assembly.

In addition to serving as a wire distribution hub that doubles, triples, or otherwise increases the number of power transmission wires, main control/distribution hub 664 may also include electronics and electronic circuitry to selectively turn power on and off at each pair of power transmission wires 666*a/c* and 666*b/d*. In such a control embodiment, a switch may be provided, wireless or wired, to turn power on and off. Hub 664 in an embodiment may include a printed-circuit board to facilitate connection between wires, as depicted in FIG. 27. Hub 664 may include a housing having a shape, such as a cylindrical shape, configured to fit within trunk cavity 618.

Power transmission wires 666 supply power to sub-control/distribution hub 668. As a distribution hub, hub 668 electrically connects incoming power transmission wires 666 to light string power wires 671.

In an embodiment, hub 668 electrically connects wires 666*a* and 666*c* to power transmission wires 670*a-d*, which in turn transmit power to trunk power supply electrical connector 672. In such an embodiment, wires 666*a* and 666*c* are "doubled" in that two pairs of power-carrying wires 670; in another such embodiment, 666*a* is connected to wire 670*a*, a single neutral wire, and wire 666*b* is connected to wires 670*b, c*, and *d* (positive polarity) such that three pairs of power supply wire configurations are possible. The four wires 666 connect to four pins or terminals of connector assembly 672. Although connector assembly 672 is referred to as a "four-pin" connector to make connection to the four wires of power transmission wires 670, in other embodiments, connector assembly 672 may comprise more or fewer electrical pins or terminals for transmitting power from wiring harness portion 610*a* to wiring harness portion 610*b*.

Hub 668 also electrically connects power transmission wires 666 to light string power wires 671 as depicted. In the depicted embodiment, wire 671*f* is in electrical connection with the plurality of wires 671*g*. As such, wires 671*f* and 671*g* share a common polarity, generally either neutral or live. Wires 671*a* to 671*e* provide the opposite polarity to each of light strings 178. As such, electrical power is provided to each connector 614, and subsequently to each light string 178.

Further, in this configuration, connector 614 and each corresponding light string 178 may be controlled individually when appropriate control electronics are available within sub-control/distribution hub 668. For example, wires 671*a* to 671*e* may be selectively powered on and off by hub 668 to control power to each light set. In such a configuration, many possible variations of flashing, pulsing and alternatively powering lights strings 178 is possible.

In other embodiments, power transmission wires 666 may comprise more or fewer wires, dependent upon such factors as the number of light strings 178 used with tree portion 604, the degree of individual control of each light string 178, or the degree of control of individual light sets of a string 178. More wires provides generally allows for greater control.

Figure 30:
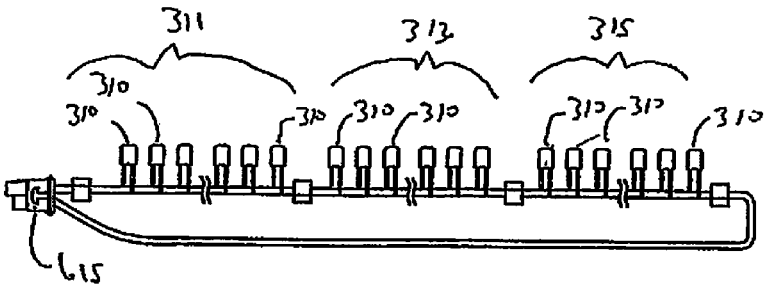
FIG. 30 is a diagram of a first light string of the tree of FIG. 26, according to an embodiment of the claimed invention.

Referring to FIG. 30, a light string 178 is depicted. In the depicted embodiment, light string 178 includes three sets of light elements 310, set 311, set 313, and set 315. Each light element 310 of an individual set is electrically connected in parallel to the other light elements in that set. In other words, all light elements 310 of set 311 are electrically connected to one another in parallel; all light elements 310 of set 312 are electrically connected in parallel to one another; and all light elements 310 of set 315 are electrically connected in parallel to one another.

Further, in the embodiment depicted, sets 311, 313, and 315 are connected in series. In one such embodiment, light string 178 receives 9 VDC power via a connector 614, and as output from transformer 660 and transmitted through hubs 664 and 668. Each light element 310 of each set thusly receives 3 VDC power.

In an embodiment, each light set includes fifteen light element assemblies 310, such that light string 178 includes 45 lights. In another embodiment, each set includes ten to twenty-five light element assemblies 310.

Although depicted and describe as a parallel-series, DC-powered light string, it will be understood that light string 178 may comprise other configurations as described above with respect to trees 100 and 500, and is not limited to the particular embodiment depicted in FIG. 30.

In an embodiment, rather than comprising a standard two-bladed power plug, each light string 178 includes a light string connector 615 that mates with a corresponding trunk-light connector 614. Connector 615 includes a pair of electrical terminals that connect with a pair of electrical terminals of connector 614, thereby making an electrical connection between connectors. In an embodiment, light-string connector 615 may comprise a male connector, while trunk-light connector 614 comprises a female connector.

In an embodiment, a connector 614 and a connector 615 comprise a locking connector system. In such an embodiment, when a portion of connector 614 is inserted into a receiving portion of connector 615, the connectors a locked together such that they cannot easily be separated. In the embodiment depicted, projections 617 of connector 614 may be pushed in to release or unlock connector 614 from connector 615. Such a locking feature provides an important safety feature for tree 600. When tree portions are assembled together, or when branches are pivoted or otherwise moved around, causing light strings 178 to move, the locking connector system prevents light strings 178 from partially or totally being removed or disconnected from the connector system, trunk, and tree.

Referring again to FIGS. 26, 27, and 29, virtually any combination of light strings 178 may be connected to tree 600. As depicted, tree portion 604 includes six light strings each having 33, 66, 33, 33, 66, and 33 light elements 310, respectively. Tree portion 606 includes five light strings 178, each having 48, 66, 36, 54, and 36 light element assemblies 310, respectively Referring to FIG. 31, an embodiment of power-supply wiring harness portion 610*b* is depicted. Electrical connector assembly 674 as depicted comprises a four-pin, or four terminal connector, such that it includes four electrical connections to the four wires of power transmission wires 676. Wiring harness portion 610*b* is substantially the same as wiring harness portion 610*a*, though portion 610*b* does not include a transformer or main control/distribution hub 664. Further, in the embodiment depicted, while hub 678 receives four incoming power transmission wires 676, hub 678 outputs fewer power transmission wires 680 and fewer light string power wires 681. Fewer light string power wires 681 are required for tree portion 606 in this embodiment, as tree portion 606 includes fewer lights. Further, fewer power transmission wires 680 are required to provide supply power to tree top portion 608.

In an embodiment, power transmission wires 680 include one neutral wire and two live or hot wires. In another embodiment, wires 680 include one live wire and two neutral wires.

In the depicted embodiment, power supply wiring harness portion 610*b*, and tree portion 606, provides power to fewer light strings 178 than does wiring harness portion 610*a*, and tree portion 604. Wiring harness portion 610*b* may also power fewer lighting elements 310 or lights than wiring harness portion 610*a*. In such an embodiment, and as depicted, wiring harness portion 610*b* powers five light strings 178. In the depicted embodiment, the five light strings each have 48, 66, 36, 54, and 36 lights (L) or lighting element assemblies 310.

Fewer light strings 178 and fewer lighting elements 310 per tree portion may be used so as to more evenly distribute lighting elements 310 about each branch 172.

When power supply wiring harness portion 610*b* is connected to 610*a*, connector assembly 674 is connected to connector assembly 672, such that the respective electrical terminals or pins of each connector are in electrical contact. Power is transmitted through the various power transmission wires 676, 680 and wires 681 to power light strings 178, and to provide supply power to connector 678 at its electrical terminals.

Figure 32:
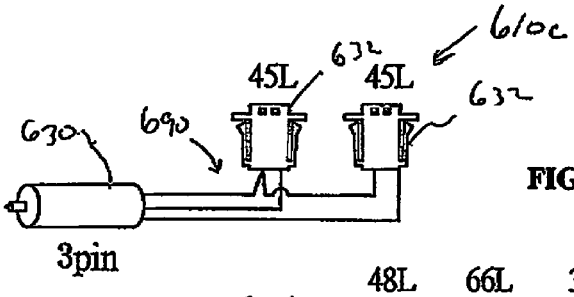
FIG. 32 is a wiring diagram of a power-supply wiring harness portion of a tree top portion of the power supply wiring harness of FIG. 27.
Figure 31:
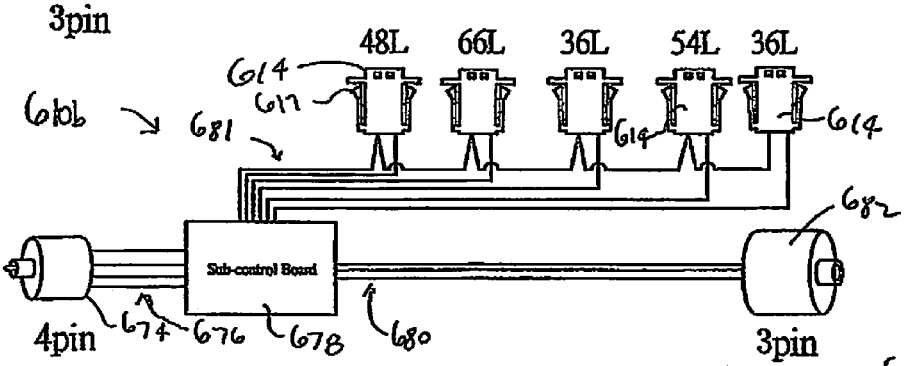
FIG. 31 is a wiring diagram of a power-supply wiring harness portion of a second tree portion of the power supply wiring harness of FIG. 27.

Referring to FIG. 32, power-supply wiring harness portion 610*c* is depicted. Wiring harness portion 610*c* includes connector assembly 630 (depicted in a simplified form in FIG. 32), wires 690, and light string connectors 632.

In an embodiment, connector assembly 630, also described in FIGS. 28*a* and 28*b*, may comprise a three-pin or three-terminal connector. Connectors assembly 630 electrically connects to connector 682 of wiring harness portion 610*c*, thus providing power to wires 690, connectors 632, and to light strings 178 (not depicted). In the depicted embodiment, wiring harness portion 610*c* provides power to two connectors 632 and thus to two light strings 178, though in other embodiments, more or fewer connectors 632 and/or light strings 178 may be included.

In an alternate embodiment, power-supply wiring harness 610*c* may comprise wires and a power-plug receiver connector (not depicted) that may receive two flat blade terminals of a conventional power plug belonging to a lighted tree top ornament (also known as a lighted "tree topper"). Although an advantage of modular lighted tree 600 is that a user need only plug in a single power cord assembly 110 to power the entire tree 600 (or tree 100 or tree 500), in this alternative embodiment, tree 600 includes a traditional power plug receptacle to power a lighted tree topper that may be placed atop mast 634, thereby eliminating the need to extend a separate power cord, or extension cord, from the bottom of tree 600 to the top of tree 600, just to power a lighted tree topper.

Various embodiments of systems, devices and methods have been described herein. These embodiments are given only by way of example and are not intended to limit the scope of the invention. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the invention.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A modular, lighted artificial tree, comprising:

a power cord configured to receive power from an external power source and provide the power to the modular, lighted artificial tree;

a first tree portion aligned along a central vertical axis, including:

a trunk portion having an upper end and a lower end, and forming a trunk wall, the trunk wall defining a trunk cavity;

a power-supply wiring harness in electrical connection with the power cord, at least a portion of the power-supply wiring harness located within the trunk cavity;

a power-supply electrical connection assembly electrically connected to the power-supply wiring harness and located at least in part within the trunk cavity, the power-supply electrical connection assembly including a first electrical contact and a second electrical contact, at least a portion of the first electrical contact positioned at a center of the power-supply electrical connection assembly and aligned along the central vertical axis;

a first light string having insulated conductors, including a first lead wire and a first return wire, and a plurality of lighting elements, the first light string being distributed about an exterior portion of the first tree portion, the first light string in electrical connection with the power-supply wiring harness, the first lead wire in electrical connection at a first common point of the power-supply wiring harness and the first return wire in electrical connection at a second common point of the power-supply wiring harness;

a second light string having insulated conductors, including a second lead wire and a second return wire, and a plurality of lighting elements, the second light string being distributed about the exterior portion of the first tree portion, the second light string electrically connected to the first light string by a light-string connector, and in electrical connection with the power-supply wiring harness, the second lead wire in electrical connection at the first common point of the power-supply wiring harness and the second return wire in electrical connection at the second common point of the power-supply wiring harness, such that both the first light string and the second light string receive power from the first and second common points of the power-supply wiring harness;

a second tree portion, including:

a trunk portion having a lower end and an upper end, the lower end having a diameter that is less than a diameter of the upper end of the trunk portion of the first tree portion and that is configured to couple to the upper end of the trunk portion of the first tree portion;

a power-supply electrical connection assembly configured to electrically connect to the power-supply electrical connection assembly of the first tree portion, the power-supply electrical connection assembly of the second tree portion including a first electrical contact and a second electrical contact, at least a portion of the first electrical contact positioned at a center of the power-supply electrical connection assembly of the second tree portion and aligned along the central vertical axis;

a power-supply wiring harness including a plurality of wires;

wherein the second tree portion is configured to couple to the first tree portion such that the power cord is in electrical connection with the power-supply wiring harness of the first tree portion, the power-supply electrical connection assembly of the first tree portion, the first light string, the second light string, the power-supply electrical connection assembly of the second tree portion, and the power-supply wiring harness of the second tree portion, thereby providing power to the first and second light strings when the power cord is electrically connected to the external power source.

2. The lighted artificial tree of claim 1, wherein a portion of the power-supply wiring harness of the second tree portion of the lighted artificial tree extends outside of the trunk cavity.

3. The lighted artificial tree of claim 1, wherein the power-supply electrical connection assembly of the first tree portion is secured to the trunk wall.

4. The lighted artificial tree of claim 1, wherein the power-supply wiring harness of the first tree portion further comprises a power distribution hub.

5. The lighted artificial tree of claim 4, wherein the power distribution hub receives a first wire having a first electrical polarity and electrically connects the first wire to a second wire and a third wire, the second and third wires having the first electrical polarity.

6. The lighted artificial tree of claim 5, wherein the first wire is coupled to the first light string and the second wire is coupled to a second light string of the first tree portion.

7. The lighted artificial tree of claim 6, wherein the first wire is coupled to the first light string by a light-string connector.

8. The lighted artificial tree of claim 4, wherein the power distribution hub is located at least in part within the trunk cavity.

9. The lighted artificial tree of claim 4, wherein the power distribution hub is independent of the power-supply electrical connection assembly of the first tree portion.

10. The lighted artificial tree of claim 1, further comprising a first wire connected at one end to the first common point and another end in electrical connection with the first and second lead wires, and a second wire connected at one end to the second common point and another end in electrical connection with the first and second return wires.

11. The lighted artificial tree of claim 1, wherein the light string connector comprises a first connector portion connecting the first lead wire and the second lead wire, and a second connector portion connecting the first return wire and the second return wire.

12. The lighted artificial tree of claim 1, wherein the plurality of lighting elements of the first light string are electrically connected in series.

13. A modular, lighted artificial tree, comprising:

a power cord configured to receive power from an external power source and provide the power to the modular, lighted artificial tree;

a first tree portion aligned along a central vertical axis, including:

a trunk portion having an upper end and a lower end, and forming a trunk wall, the trunk wall defining a trunk cavity;

a power-supply wiring harness in electrical connection with the power cord, at least a portion of the power-supply wiring harness located within the trunk cavity;

a power-supply electrical connection assembly electrically connected to the power-supply wiring harness and located at least in part within the trunk cavity, the power-supply connection assembly including a first electrical contact and a second electrical contact;

a first light string having insulated conductors, including a first lead wire and a first return wire, and a plurality of lighting elements, the first light string being distributed about an exterior portion of the first tree portion, the first light string in electrical connection with the power-supply wiring harness, the first lead wire in electrical connection at a first common point of the power-supply wiring harness and the first return wire in electrical connection at a second common point of the power-supply wiring harness;

a second light string having insulated conductors, including a second lead wire and a second return wire, and a plurality of lighting elements, the second light string being distributed about the exterior portion of the first tree portion, the second light string electrically connected to the first light string by a light-string connector, and in electrical connection with the power-supply wiring harness, the second lead wire in electrical connection at the first common point of the power-supply wiring harness and the second return wire in electrical connection at the second common point of the power-supply wiring harness, such that both the first light string and the second light string receive power from the first and second common points of the power-supply wiring harness;

a second tree portion, including:

a trunk portion having a lower end and an upper end, the lower end configured to couple to the upper end of the trunk portion of the first tree portion;

a power-supply electrical connection assembly configured to electrically connect to the power-supply electrical connection assembly of the first tree portion, the power-supply electrical connection assembly of the second tree portion including a first electrical contact and a second electrical contact;

a power-supply wiring harness including a plurality of wires;

wherein the second tree portion is configured to couple to the first tree portion such that the power cord is in electrical connection with the power-supply wiring harness of the first tree portion, the power-supply electrical connection assembly of the first tree portion, the first light string, the second light string, the power-supply electrical connection assembly of the second tree portion, and the power-supply wiring harness of the second tree portion, thereby providing power to the first tree portion, including the first and second light strings, and the second tree portion, when the power cord is electrically connected to the external power source.

14. The lighted artificial tree of claim 13, further comprising a first wire connected at one end to the first common point and another end in electrical connection with the first and second lead wires, and a second wire connected at one end to the second common point and another end in electrical connection with the first and second return wires.

15. The lighted artificial tree of claim 13, wherein the light string connector comprises a first connector portion connecting the first lead wire and the second lead wire, and a second connector portion connecting the first return wire and the second return wire.

16. The lighted artificial tree of claim 13, wherein the plurality of lighting elements of the first light string are electrically connected in series.

17. The lighted artificial tree of claim 1, wherein the first common point of the power-supply wiring harness is located external to the trunk portion, such that the first common point is not within the trunk cavity.

18. The lighted artificial tree of claim 13, wherein the first common point of the power-supply wiring harness is located external to the trunk portion, such that the first common point is not within the trunk cavity.

* * * * *